US005363184A

United States Patent [19]

Matsuo et al.

[11] Patent Number: 5,363,184

[45] Date of Patent: Nov. 8, 1994

[54] AUTOMATIC DOCUMENT CONVEYING DEVICE HAVING FIRST AND SECOND PIVOTING FRAMES

[75] Inventors: Takeshi Matsuo, Higashi; Shinya Aono, Amagasaki; Toshinori Muraoka, Osaka, all of Japan

[73] Assignee: Mita Industrial Company Ltd., Osaka, Japan

[21] Appl. No.: 953,969

[22] Filed: Sep. 29, 1992

[30] Foreign Application Priority Data

Sep. 30, 1991 [JP] Japan ..... 3-276388

[51] Int. Cl.[5] ..... G03G 15/00

[52] U.S. Cl. ..... 355/309; 271/7; 355/75; 355/231

[58] Field of Search ..... 355/75, 230, 231, 318, 355/308, 309, 320; 271/3, 3.1, 7, 4, 10, 198, 184, 185, 186

[56] References Cited

U.S. PATENT DOCUMENTS

| | | | |
|---|---|---|---|
| 3,661,383 | 5/1972 | Morrison | 271/51 |
| 4,523,831 | 6/1985 | Yokoo et al. | 355/231 |
| 5,003,347 | 3/1991 | Kameda | 355/75 |
| 5,060,923 | 10/1991 | Takimoto et al. | 271/7 |
| 5,061,961 | 10/1991 | Jacobs et al. | 355/212 |
| 5,220,393 | 6/1993 | Otomo | 355/308 |

FOREIGN PATENT DOCUMENTS

| | | | |
|---|---|---|---|
| 0115458 | 7/1983 | Japan | 355/75 |
| 0081494 | 4/1988 | Japan | 355/230 |
| 0298331 | 12/1988 | Japan | 355/231 |
| 0064534 | 3/1990 | Japan | 355/75 |
| 0130755 | 6/1991 | Japan | 355/230 |

*Primary Examiner*—A. T. Grimley
*Assistant Examiner*—Robert Beatty

[57] ABSTRACT

An automatic document conveying device is equipped with an opening/closing frame and a swing frame which are mounted on a main frame. When the opening/closing frame is turned to an open position, the document introduction passage is at least partly opened. In the document introduction passage are arranged an introduction roller, a pressing member, a feed roller, a separation roller and a plurality of document detectors. A conveyer belt mechanism is mounted on the swing frame. A plurality of electric wires are arranged extending from the opening/closing frame passing through an opening formed in the side plate of the main frame.

7 Claims, 14 Drawing Sheets

AUTOMATIC DOCUMENT CONVEYING DEVICE HAVING FIRST AND SECOND PIVOTING FRAMES

FIELD OF THE INVENTION

The present invention relates to an automatic document conveying device adapted to an image processing machine such as an electrostatic copying machine or an image reader.

DESCRIPTION OF THE PRIOR ART

In an automatic document conveying device such as an electrostatic copying machine or an image reader, a transparent plate which may be made of a glass is disposed on the upper surface of a housing, and a document to be copied or to be read must be placed at a required position on the transparent plate. In order to automatically carry out the document processing operation, a variety of automatic document conveying devices have been proposed and put into practical use in recent years which allow the introduction of the document to be copied or read to a required position on the transparent plate and then deliver it out of the transparent plate. There can be cited, for example, Japanese Patent Laid-Open Publications Nos. 229744/1986 and 295334/1988 as prior literature describing typical automatic document conveying devices.

In such a typical automatic document conveying device, a main frame is mounted on the housing of an image processor to swing between a closed position and an open position on a main frame swing axis that extends along one end edge of the transparent plate. The main frame has the shape of nearly a box with a lower surface that is usually open, and covers the transparent plate when it is brought to the closed position and permits the transparent plate to be exposed to view when it is brought to the open position. When the document is to be placed on the transparent plate by hand, the main frame must be opened and then closed. The main frame is equipped with a document placing means and a document receiving means. In the main frame are further defined a document introduction passage from the document placing means to the upper surface of the transparent plate, and a document delivery passage from the upper surface of the transparent plate to the document receiving means. There is further provided a document conveying means which conveys the document through the document introduction passage, along the upper surface of the transparent plate and through the document delivery passage. The document conveying means includes a document introduction means for conveying the document through the document introduction passage, a conveyer belt mechanism for conveying the document along the upper surface of the transparent plate, and a document delivery means for conveying the document through the document delivery passage. When the main frame is brought to the closed position, the conveyer belt mechanism is positioned opposed to the transparent plate.

At an end portion of the main frame is arranged an opening/closing frame which swings on an opening/-closing frame swing axis which preferably extends substantially perpendicularly to the main frame swing axis. A first introduction passage defining means is disposed at an end portion of the main frame, a second introduction passage defining means is disposed on the opening/closing frame, and the document introduction passage is defined by the first introduction passage defining means and the second introduction passage defining means that operate in cooperation together. The document introduction passage is opened by swinging the opening/closing frame from the closed position to the open position. The document introduction means that conveys the document through the document introduction passage includes an introduction roller mounted on the main frame and a pressing member which is also mounted on the main frame. The pressing member is swingably mounted and is selectively located between an acting position where it approaches or comes in contact with the introduction roller and a non-acting position where it separates away from the introduction roller, driven by a pressing member positioning means which may be an electromagnetic solenoid. The document introduction means further includes a feed roller mounted on the main frame and a separation roller mounted on the opening/closing frame. The feed roller is rotated in a direction of conveying the document and the separation roller is rotated, via a torque limiter, in a direction opposite to the direction of conveying the document, in order to prevent two or more pieces of documents from being fed simultaneously. The opening/closing frame is further equipped with a restricting member which is located close to the feed roller on the upstream side of the separation roller and which prevents many pieces of documents from being simultaneously introduced between the feed roller and the separation roller. A plurality of document detectors are arranged in the document introduction passage to detect the size of the document that is introduced through the document introduction passage. The document detectors are reflection-type optical detectors each including a light-emitting element which projects light toward the document introduction passage and a light-receiving element which receives light projected from the light-emitting element and reflected by the document.

Here, however, the conventional automatic document conveyer devices have the following problems that must be solved.

First, when the documents have jammed (clogged) in the document introduction passage, the pressing member is brought to the non-acting position and is separated away from the introduction roller. Then, the opening/closing frame is turned from the closed position to the open position, and the separation roller and the restricting member are separated away from the feed roller. Thereafter, the jammed documents are removed by hand from the document introduction passage. Here, however, a relatively small limited operation stroke is imparted to a pressing member, positioning means which is usually constituted by an electromagnetic solenoid, to selectively bring the pressing member to the acting position or to the non-acting position, and only relatively small space is available for connecting the pressing member positioning means and the pressing member together. Therefore, even when the pressing member is turned from the acting position to the non-acting position, the space produced between the pressing member and the introduction roller is relatively small. When it is attempted to remove the jammed documents from the introduction passage by hand, therefore, the operation of removing the documents is hindered by the pressing member, and the documents are often damaged by the corners of the pressing member.

Second, the separation roller that works in cooperation together with the feed roller is made of a relatively soft material, such as a synthetic rubber, and is worn out during use and, hence, must be renewed after it has been used repetitively. Here, the separation roller mounted on the opening/closing frame must be resiliently pressed onto the feed roller. However, the constitution that produces the resiliently pressing force is covering the separation roller, and makes it relatively difficult and cumbersome to replace the separation roller.

Third, in order for the restricting member that works in cooperation with the feed roller to perform its restricting function as desired, the free edge of the restricting member must be positioned sufficiently accurately with respect to the feed roller and must further be held at the required position sufficiently reliably without deviating from this required position even when the document comes in contact thereto. If the restricting member is made of a rigid metal plate to satisfy the above requirement, the document is liable to be damaged when it comes in contact with a cut edge or a corner of the restricting member. If the restricting member is made of a synthetic rubber or a resin film to keep the document from being damaged, the front edge of the restricting member is easily distorted as the document comes in contact thereto and the restricting member loses its stability in operation.

Fourth, a variety of electric elements such as detectors must be arranged not only on the main frame but also on the opening/closing frame that is mounted on the main frame to be opened and closed, and the electric wires of these electric elements are usually extended outwardly in the width direction passing through an opening formed in the rear side plate (or front side plate) of the main frame. In this case, there occurs a change in the distance between the electric elements mounted on the opening/closing frame and the opening formed in the rear side plate (or front side plate) of the main frame when the opening/closing frame is opened or closed. Therefore, the electric wires extending through the opening formed in the rear side plate (or front side plate) of the main frame must have length equal to or longer than maximum length between the electric elements and the opening so as to cope with this change in the distance. When the opening/closing frame is swung between the open position and the closed position, however, the electric wires are excessively loosened near the opening of the rear side plate (or the front side plate) of the main plate and are often bit between the main frame and the opening/closing frame, so that smooth opening or closing operation of the opening/closing frame is impeded and the electric wires are often broken. When the opening/closing frame is opened and closed, furthermore, an excess tensile force is given to the electric wires, which then often come off the electric elements. If the opening in the rear side plate (or the front side plate) of the main frame is provided into agreement with the swing axis of the opening/closing frame, the distance does not substantially change between the electric elements and the opening even when the opening/closing frame is turned, enabling the above-mentioned problem to be solved. Due to various limitations in the design of allowable space, however, it is in many cases difficult to form the opening in alignment with the swing axis of the opening/closing frame.

Fifth, a plurality of document detectors are disposed in the document introduction passage to detect the size of document and, particularly, to detect the size in the width direction of the document introduced through the document introduction passage. Each document detector is constituted by a reflection-type optical detector having a light-emitting element which projects light to the document introduction passage and a light-receiving element which receives the light that is projected from the light-emitting element and then reflected by the document, the light-emitting element and the light-receiving element being arranged in the direction in which the document is carried. In order to arrange such document detectors, however, an area is required which is greater than a required size, i.e., greater than the sum of the lengths of the light-emitting elements in the conveying direction and the lengths of the light-receiving elements in the conveying direction, making it difficult to provide the document introduction passage in a compact size.

Sixth, an endless belt in a conveyer belt mechanism that is opposed to the transparent plate when the main frame is located at the closed position directly covers the document placed on the transparent plate and works as a reflection means for reflecting the light projected to the document and to the periphery thereof. The endless belt, therefore, must be replaced by a new one when it is contaminated after it has been used repetitively. However, even when the main frame is brought to the open position, the conveyer belt mechanism remains covered with the main frame; i.e., only the lower running portion (active running portion for conveying a document, which is located opposed to the transparent plate) of the endless conveyer belt is exposed to view, and replacement of the endless belt involves a considerably cumbersome operation.

SUMMARY OF THE INVENTION

A first object of the present invention is to improve an automatic document conveying device which permits documents jammed in the document introduction passage to be very easily removed, without being hindered by the pressing member, by turning the opening/closing frame from the closed position to the open position.

A second object of the present invention is to provide an improved automatic document conveying device which permits the separation roller mounted on the opening/closing frame to be replaced very easily.

A third object of the present invention is to provide an improved automatic document conveying device in which the free edge of the restricting member is positioned very accurately with respect to the feed roller, the restricting member is held at the required position without undergoing displacement even when the document comes in contact therewith, and the document is not damaged even when it comes in contact with the restricting member.

A fourth object of the present invention is to provide an improved automatic document conveying device in which the electric wires outwardly extending in the direction of width through an opening from the electric elements mounted on the opening/closing frame are reliably prevented from being bit between the main frame and the opening/closing frame at the time when the opening/closing frame is turned between the closed position and the open position, and excess tensile force is reliably prevented from being imparted to the electric wires, though the opening formed in the rear side plate (or the front side plate) of the main frame is displaced from the swing axis of the opening/closing frame.

A fifth object of the present invention is to provide an improved automatic document conveying device which has additional minimum and compact space that is necessary for arranging a plurality of reflection-type optical detectors for detecting the size in the width direction of the document that passes through the document introduction passage.

A sixth object of the present invention is to provide an improved automatic document conveying device in which the endless belt can be replaced very easily in the conveyer belt mechanism.

In order to achieve the above first object according to a first aspect of the present invention, the opening/-closing frame acts upon the pressing member such that it is located at a retracted position sufficiently separated away from the introduction roller when the opening/-closing frame is turned from the closed position to the open position.

That is, in order to achieve the above first object according to the first aspect of the present invention, there is provided an automatic document conveying device comprising:

a main frame;

an opening/closing frame mounted on said main frame to swing between a closed position and an open position on an opening/closing frame swing axis that extends in the direction of width;

a first introduction passage defining means disposed in said main frame;

a second introduction passage defining means which is disposed in said opening/closing frame and, when said opening/closing frame is located at said closed position, works in cooperation together with said first introduction passage defining means to define a document introduction passage between them;

an introduction roller rotatably mounted on said main frame;

a driving source for driving said introduction roller;

a pressing member mounted on said main frame to swing on a pressing member swing axis that extends in the direction of width; and a pressing member positioning means which selectively positions said pressing member at an acting position where it is brought close to or in contact with said introduction roller and a non-acting position where it is separated away from said introduction roller;

wherein when said opening/closing frame is turned from said closed position to said open position, said opening/closing frame acts upon said pressing member such that said pressing member is turned to a retracted position beyond said non-acting position and is separated away from said introduction roller.

In order to achieve the above second object according to a second aspect of the present invention, a support bracket is mounted on the opening/closing frame to swing on a support bracket swing axis that extends in the direction of width, a separation roller is mounted on the support bracket, and an end of a spring member is coupled to the support bracket, so that, when the opening/closing frame is brought to the closed position, the separation roller is pressed onto the feed roller due to the resilient urging action of the support bracket produced by the spring member.

That is, in order to achieve the above second object according to the second aspect of the present invention, there is provided an automatic document conveying device comprising:

a main frame;

an opening/closing frame mounted on said main frame to swing between a closed position and an open position on an opening/closing frame swing axis that extends in the direction of width;

a first introduction passage defining means disposed in said main frame;

a second introduction passage defining means which is disposed in said opening/closing frame and, when said opening/closing frame is located at said closed position, works in cooperation together with said first introduction passage defining means to define a document introduction passage between them;

a feed roller rotatably mounted on said main frame;

a separation roller which is rotatably mounted on said opening/closing frame and is opposed to said feed roller when said opening/closing frame is brought to said closed position; and a driving source which drives said feed roller in a direction of conveying the document and drives said separation roller in a direction opposite to said direction of conveying the document;

wherein a support bracket is mounted on said opening/closing frame to swing on a support bracket swing axis that extends in the direction of width, a resiliently urging means is disposed to resiliently urging said support bracket in a predetermined direction, said separation roller is rotatably mounted on said support bracket, and when said opening/closing frame is brought to said closed position, said separation roller is pressed onto said feed roller by the resilient urging action of said resiliently urging means, one end of said resiliently urging means being comprised of a spring member that is detachably coupled to said support bracket.

In order to achieve the above third object according to a third aspect of the present invention, a restricting member is constituted by a rigid metal plate and a synthetic rubber plate disposed on one surface of the metal plate, and the tip of the synthetic rubber plate is located substantially in match with or slightly at the back of the tip of the metal plate, so that the document introduced into between the feed roller and the separation roller comes in contact with the synthetic rubber plate only, without coming in contact with the metal plate.

That is, in order to achieve the above third object according to the third aspect of the present invention, there is provided an automatic document conveying device comprising a feed roller, a separation roller opposed to said feed roller, and a restricting member which approaches said feed roller on the upstream side of said separation roller as viewed in a direction of conveying the document, wherein said restricting member includes a rigid metal plate and a synthetic rubber plate disposed on one surface of said metal plate, the tip of said synthetic rubber plate is located substantially in match with or slightly at the back of the tip of said metal plate, and the document introduced between said feed roller and said separation roller is permitted to come in contact with said synthetic rubber plate only, without coming in contact with said metal plate.

In order to achieve the above fourth object according to a fourth aspect of the present invention, predetermined portions of the electric wires are fastened to opening/closing frame or to the main frame on the inside or outside of the opening formed in the side plate of the main frame, and an end of a spring member is coupled to the predetermined portions of the electric wires on the outside or the inside of the opening formed in the side plate in order to resiliently urge the electric wires inwardly or outwardly to separate them away from the opening.

That is, in order to achieve the above fourth object according to the fourth aspect of the present invention, there is provided an automatic document conveying device comprising a main frame and an opening/closing frame mounted on said main frame to swing between the closed position and the open position on an opening/closing frame axis that extends in the direction of width, a plurality of electric elements being arranged in said opening/closing frame, electric wires extending outwardly in the direction of width from said electric elements passing through an opening formed in the side plate of said main frame, wherein predetermined portions of said electric wires are fastened to said opening/closing frame on the inside of said opening of said side plate, and an end of a spring member is coupled to predetermined portions of said electric wires on the outside of said opening to resiliently urge the electric wires outwardly away from said opening.

Similarly, in order to achieve the fourth object according to the fourth aspect of the present invention, there is provided an automatic document conveying device comprising a main frame and an opening/closing frame mounted on said main frame to swing between the closed position and the open position on an opening/closing frame axis that extends in the direction of width, a plurality of electric elements being arranged on said opening/closing frame, and the electric wires extending outwardly in the direction of width from said electric elements passing through an opening formed in the side plate of said main frame, wherein predetermined portions of said electric wires are fastened to said main frame on the outside of said opening of said side plate, and an end of a spring member is coupled to predetermined portions of said electric wires on the inside of said opening to resiliently urge said electric wires inwardly away from said opening.

In order to achieve the above fifth object according to a fifth aspect of the present invention, a plurality of reflection-type optical detectors constituting the document detector are arranged substantially in alignment in the direction of width in a manner that the light-emitting elements and the light-receiving elements of the reflection-type optical detectors are arranged in parallel in the direction of width.

That is, in order to achieve the fifth object according to the fifth aspect of the present invention, there is provided an automatic document conveying device in which a plurality of document detectors are arranged to detect the size in the direction of width of a document that is conveyed through the document introduction passage, each of said document detectors being a reflection-type optical detector including a light-emitting element which projects light toward the document conveying passage and a light-receiving element which receives light projected from said light-emitting element and reflected by the document, wherein said plurality of detectors are arranged substantially in alignment in the direction of width in such a manner that the light-emitting elements and the light-receiving elements of said detectors are arranged in parallel in the direction of width.

In order to achieve the sixth object according to a sixth aspect of the present invention, a swing frame is mounted on the main frame to swing on a separation swing axis which is close to and extends in parallel with the main frame swing axis, the swing frame is removably coupled to the main frame through a coupling means, a conveyer belt mechanism is mounted on the swing frame, wherein when the main frame is brought to the closed position under the condition where the swing frame is coupled to the main frame through the coupling means, the conveyer belt mechanism is positioned opposed to the transparent plate, and when the main frame is brought to the open position and is liberated from the swing frame that had been coupled thereto through the coupling means, the swing frame on which the conveyer belt mechanism is mounted is turned on the separation swing axis and is separated from the main frame.

That is, in order to achieve the sixth object according to the sixth aspect of the present invention, there is provided an automatic document conveying device applied to an image processor equipped with a housing which has a transparent plate placed on the upper surface thereof, said automatic document conveying device comprising a main frame that is mounted to swing on a main frame swing axis which extends along one edge of said transparent plate between a closed position where it covers said transparent plate and an open position where it permits said transparent plate to be exposed to view, and a conveyer belt mechanism which is mounted on said main frame and is positioned opposed to said transparent plate when said main frame is brought to said closed position, wherein a swing frame is mounted on said main frame to swing on a separation swing axis which is close to and extends in parallel with said main frame swing axis, a coupling means removably couples said swing frame to said main frame, said conveyer belt mechanism is mounted on said swing frame, and when said main frame is brought to said closed position under the condition where said swing frame is coupled to said main frame by said coupling means, said conveyer belt mechanism is positioned opposed to said transparent plate, and when said main frame is brought to said open position to liberate said swing frame from said main frame to which said swing frame is coupled via said coupling means, said swing frame on which said conveyer belt mechanism is mounted is permitted to be turned on said separation swing axis and is separated from said main frame.

In the automatic document conveying device constituted according to the first aspect of the present invention, the pressing member is turned to the retracted position with the turning of the opening/closing frame when this opening/closing frame is turned from the closed position to the open position to remove the documents jammed in the document introduction passage. That is, the pressing member is sufficiently separated away from the introduction roller, and it is possible to very easily remove the jammed documents without being hindered by the pressing member.

In the automatic document conveying device constituted according to the second aspect of the present invention, the separation roller can be exposed to view and can be replaced very easily when the opening/closing frame is turned to the open position and the support bracket is turned in a predetermined direction on the support bracket swing axis after an end of the spring member is separated from the support bracket.

In the automatic document conveying device constituted according to the third aspect of the present invention, the edge of the synthetic rubber plate does not undergo displacement but is held at the required position very reliably, even when the document comes in contact, as a result of the presence of the rigid metal plate. Moreover, the document comes in contact with the synthetic rubber plate but does not come in contact with the metal plate. Thus, the desired action of the pressing member is maintained, and the document is reliably prevented from being damaged.

In the automatic document conveying device constituted according to the fourth aspect of the present invention, the spring member resiliently moves the electric wires outwardly or inwardly with the turning of the opening/closing frame, and the electric wires are prevented from being excessively slackened or from being excessively pulled. This makes it possible to reliably prevent the electric wires from being bit between the moving frame and the main frame or from being broken.

In the automatic document conveying device constituted according to the fifth aspect of the present invention, a plurality of reflection-type optical detectors constituting the document detector are arranged in the direction of width in which sufficient spatial margin is provided in a manner that the light-emitting elements and the light-receiving elements of the reflection-type optical detectors are arranged in parallel in the direction of width. Therefore, the area for arranging the document detectors can have a size of the light-emitting elements or the light-receiving elements of the reflection-type optical detectors, enabling the document introduction passage to be provided in a very compact size.

In the automatic document conveying device constituted according to the sixth aspect of the present invention, the swing frame and the conveyer belt mechanism mounted thereon are separated from the main frame, and the conveyer belt mechanism is exposed to view if the main frame is brought to the open position, if the main frame coupled to the swing frame via the coupling means is liberated therefrom, and if the swing frame is turned on the separation swing axis. Therefore, the endless belt of the conveyer belt mechanism can be replaced very easily.

DETAILED DESCRIPTION OF THE PREFERRED EMBODIMENTS

A preferred embodiment of the automatic document conveying device constituted according to the present invention will now be described in more detail by reference to the accompanying drawings.

Figure 1:
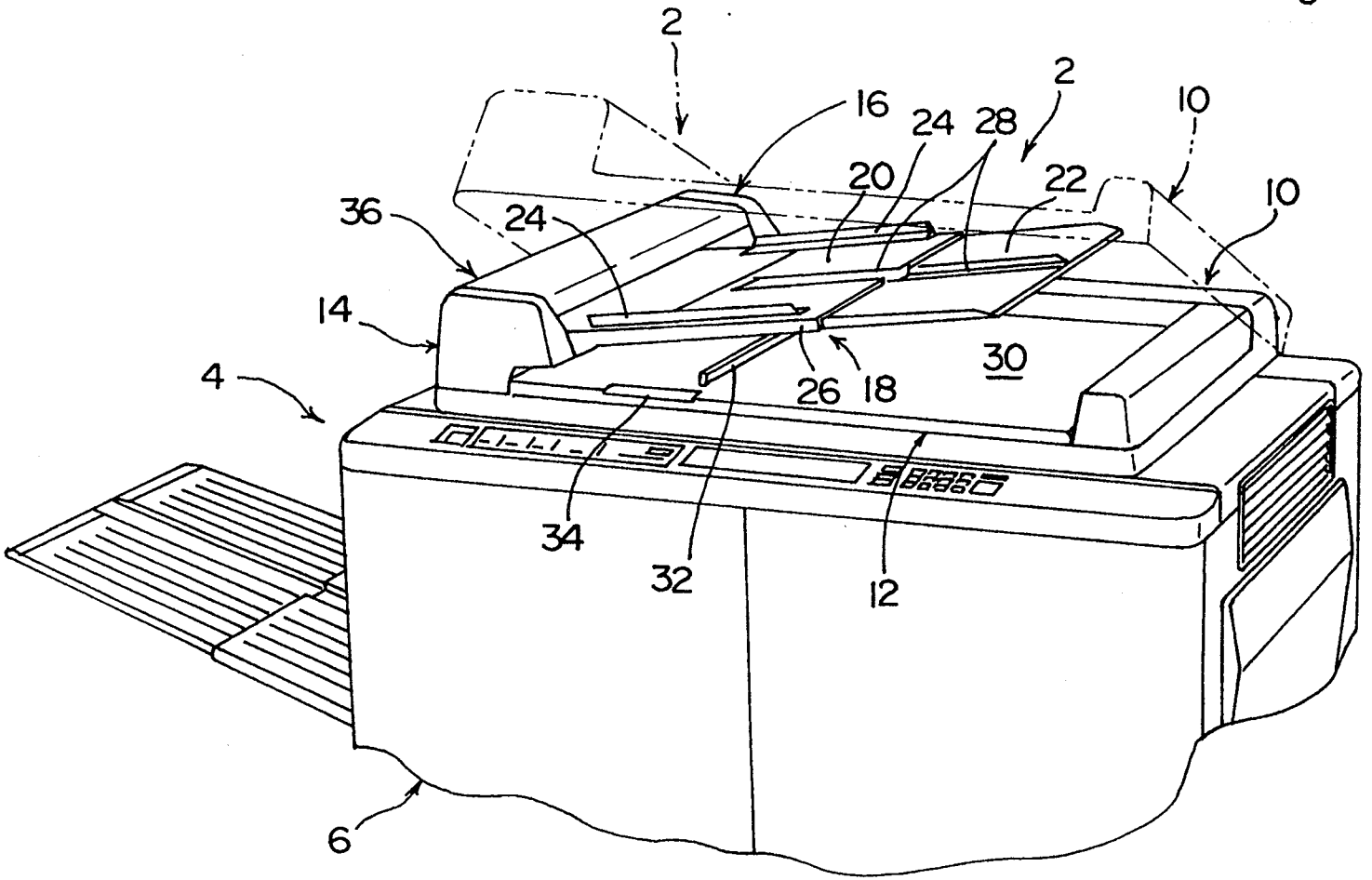
FIG. 1 is a perspective view showing a situation where an automatic document conveying device constituted according to a preferred embodiment of the present invention is mounted on an electrostatic copying machine.
Figure 2:
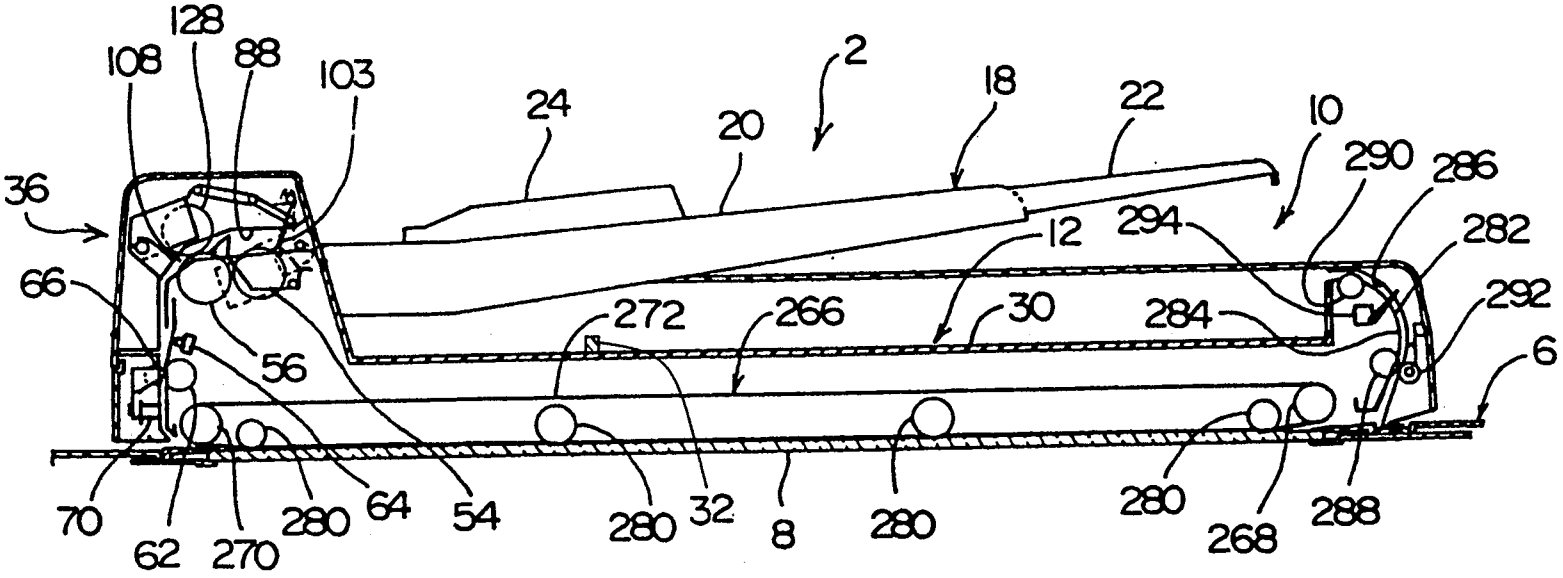
FIG. 2 is a sectional view illustrating the automatic document conveying device of FIG. 1.

Description is made with reference to FIGS. 1 and 2. An automatic document conveying device which is generally designated at 2 in the above Figures is applied to an electrostatic copying machine 4 in this embodiment. The electrostatic copying machine 4 has a housing 6 of a nearly rectangular prism shape. A transparent plate 8 (FIG. 2), which may be made of a glass, is disposed on the upper surface of the housing 6. The document to be copied must be placed on a required position on the transparent plate 8. The electrostatic copying machine 4 itself may be of a known type and, hence, its constitution is not described here.

The automatic document conveying device 2 constituted according to the present invention is equipped with a main frame 10 which is mounted on the housing 6 of the electrostatic copying machine 4 to swing on a main frame swing axis that extends along the rear edge of the transparent plate 8 between a closed position indicated by a solid line in FIG. 1 and an open position indicated by a two-dot chain line in FIG. 1 (the manner of mounting the main frame 10 will be described later). The main frame 10 includes a frame member 12 of nearly a box shape. The lower surface of the frame member 12, that can be made of a suitable synthetic resin, is open as will be understood from FIG. 2. One end of the main frame 10 (left end in FIG. 2) is upwardly swollen (a document introduction passage is formed in this end portion as will be described later). Similarly, the other end of the main frame 10 (right end in FIG. 2) is upwardly swollen (a document discharge passage is formed in this end portion as will be described later). As clearly illustrated in FIG. 1, an upright front wall portion 14 and an upright rear wall portion 16 are formed, spaced apart in the direction of width (in a direction perpendicular to the surface of the paper in FIG. 2), on the frame member 12 at the one end of the main frame 10. A document placing means 18 that rightwardly extends in FIG. 2 is disposed between the front wall portion 14 and the rear wall portion 16. The document placing means 18 includes a placing member 20 and an auxiliary placing member 22. The placing member 20 is nearly of a rectangular shape and rightwardly extends in FIG. 2 from the front end thereof that is fixed between the front wall portion 14 and the rear wall portion 16. A pair of width restriction members 24 are arranged on the upper surface of the placing member 20 and are allowed to move in a direction to approach or separate away from each other. Guide rails 26 of an L-shape in cross section are integrally formed at the front edge and the rear edge of the placing member 20. The auxiliary placing member 22 of nearly a rectangular shape is inserted between the guide rails 26 and is incorporated in the placing member 20 so as to move toward the right and left directions in FIG. 2. A groove 28 that extends from the right to left in FIG. 2 is formed in the placing member 20 and the auxiliary placing member 22 at the central portion in the direction of width. The central main portion of the frame member 12, located below the document placing means 18, has a substantially flat upper surface and constitutes a document-receiving means 30 which receives the document discharged from the other swollen end portion of the main frame 10. A protuberance 32 is formed, extending in the direction of width, on the upper surface of the flat central main portion of the frame member 12. The protuberance 32 constitutes a document stopper which will come in contact the leading edge of the document that is discharged onto the document-receiving means 30. A forwardly protruded grip 34 is formed at the front edge of the central main portion of the frame member 12. The grip 34 can be held by hand to turn the main frame 10 between an closed position indicated by a solid line and an open position indicated by a two-dot chain line in FIG. 1.

Figure 3:
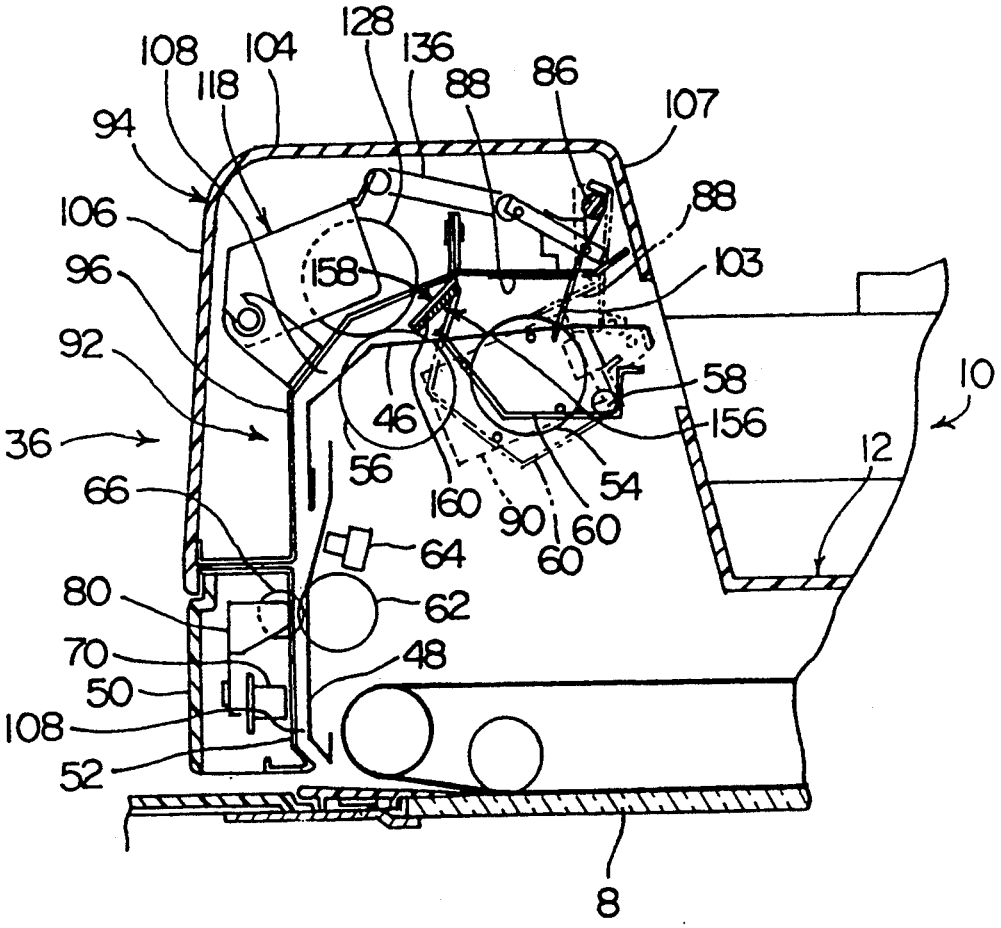
FIG. 3 is a partial sectional view illustrating a portion of the automatic document conveying device of FIG. 1.
Figure 4:
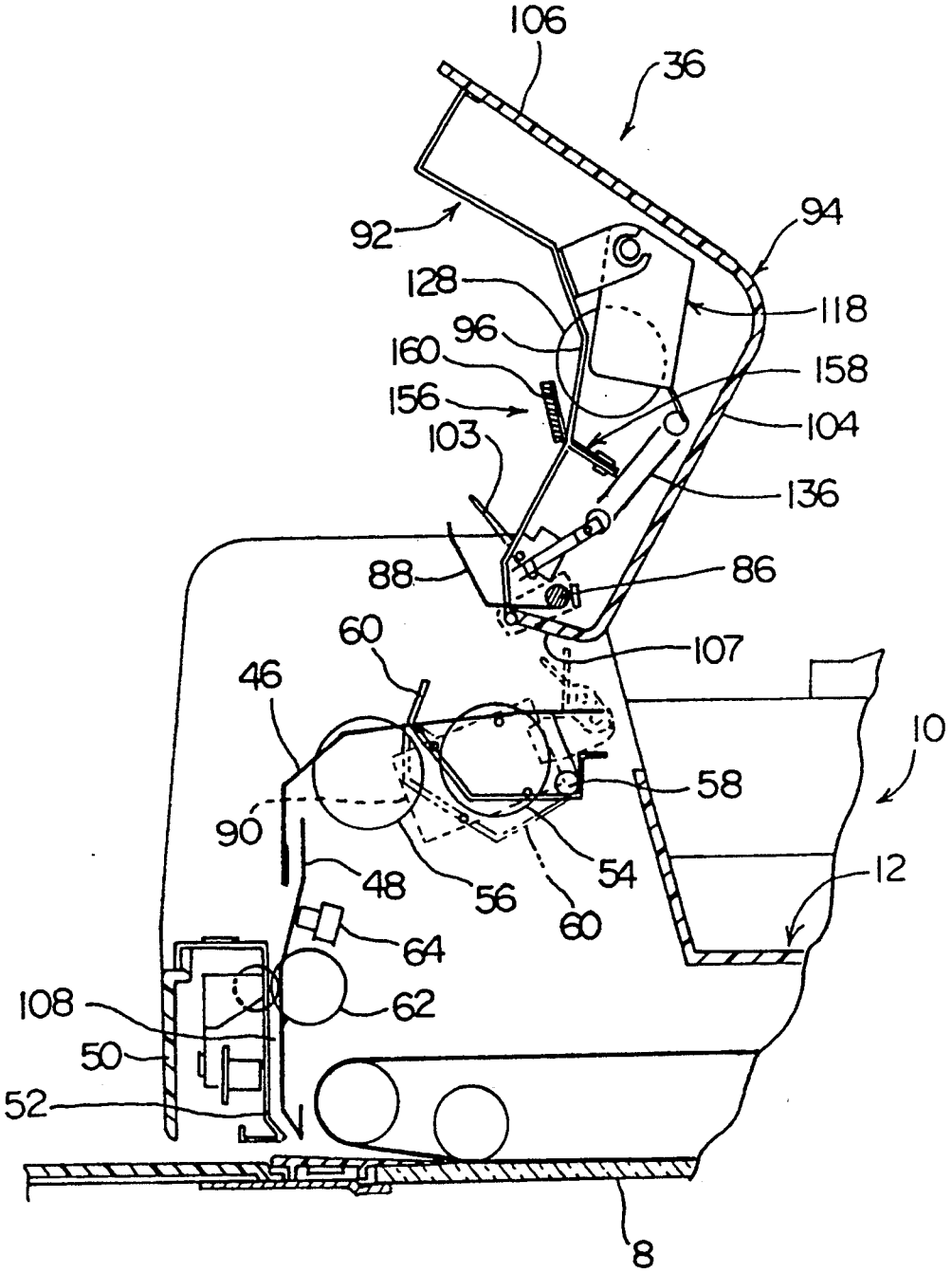
FIG. 4 is a partial sectional view, like that of FIG. 3, showing a portion of the automatic document conveying device of FIG. 1 under the condition where an opening/closing frame is brought to the open position.

With reference to FIGS. 3 and 4 together with FIGS. 1 and 2, an opening/closing frame 36 is disposed between the upright front wall portion 14 and the upright rear wall portion 16 of the frame member 12 at the one end of the main frame 10. The opening/closing frame 36 is mounted to swing on the opening/closing frame swing axis that extends vertically to the surface of the paper in FIGS. 3 and 4 between the closed position shown in FIGS. 1, 2 and 3 and the open position shown in FIG. 4 (mounting of the opening/closing frame 36 will be described later in further detail).

Figure 5:
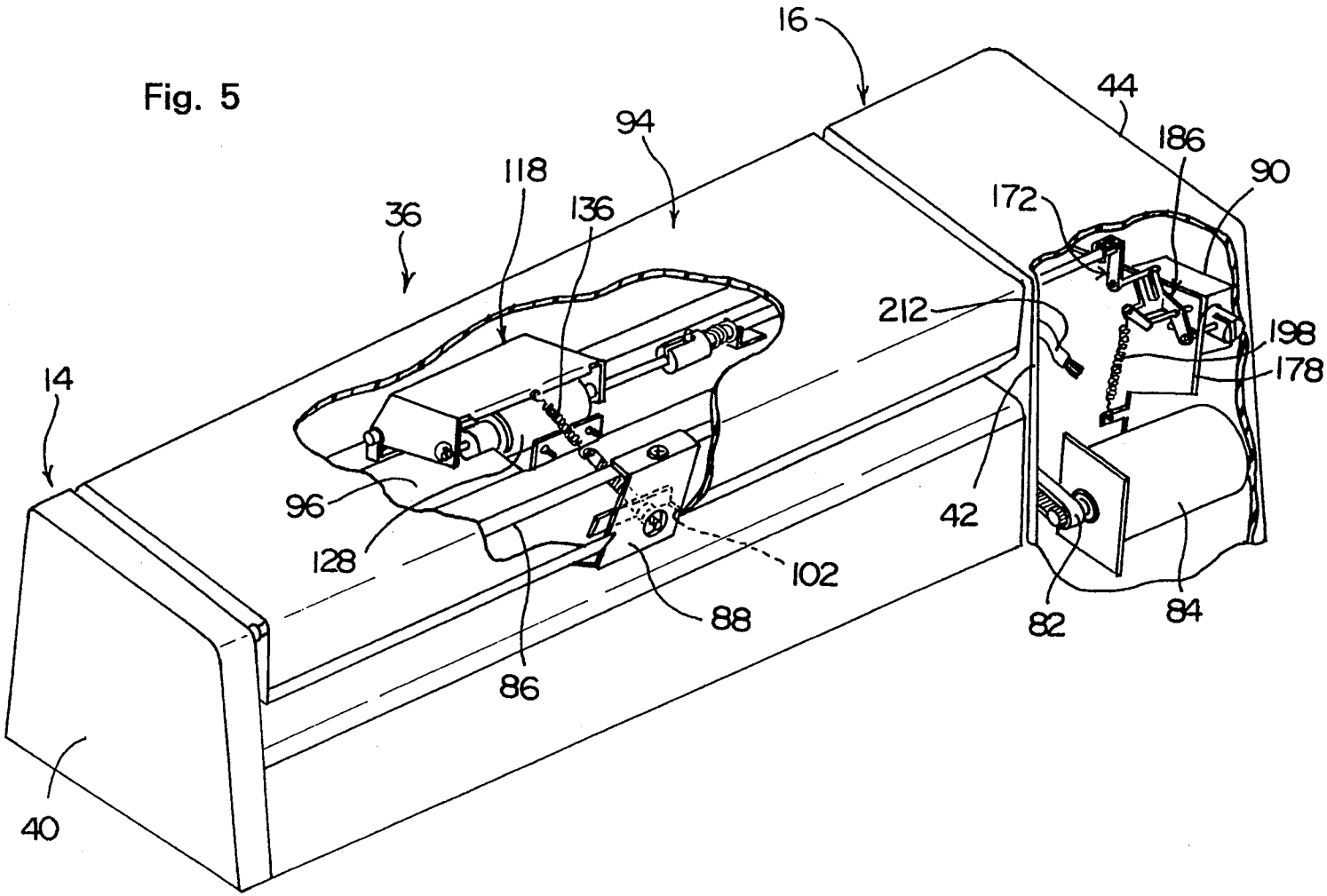
FIG. 5 is a partial perspective view showing a portion of the automatic document conveying device of FIG. 1 in a partly cut-away manner.
Figure 6:
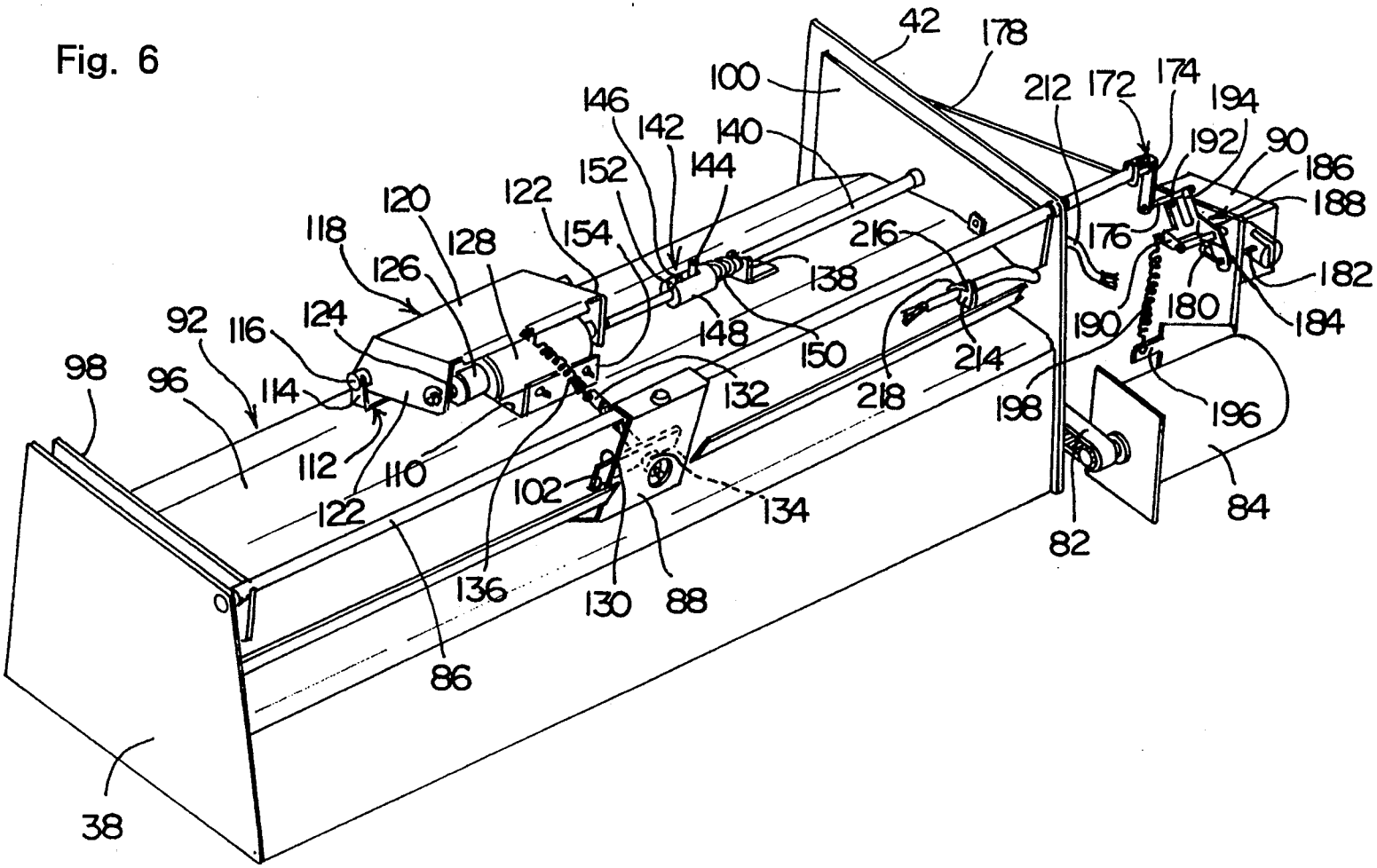
FIG. 6 is a partial perspective view, like that of FIG. 5, showing a portion of the automatic document conveying device of FIG. 1 under the situation where a cover of the opening/closing frame is removed.

As will be comprehended from FIGS. 5 and 6, the upright front wall portion 14 of the frame member 12 has an upright front side plate 38 and a front cover 40 for covering the front surface of the upright front side plate 38. Similarly, the upright rear wall portion 16 of the frame member 12 has an upright rear side plate 42 and a rear cover 44 that covers the rear surface of the upright rear side plate 42. With reference to FIGS. 3 and 4, guide plates 46 and 48 are mounted between the upright front side plate 38 and the upright rear side plate 42. The frame member 12 is provided with an end wall member 50 which is positioned on the outside (left side) of the lower portion of the guide plate 48, and a guide plate 52 is provided on the inside of the end wall member 50. The main portion of the guide plate 52 extends up- and downwardly, being opposed to the lower half of the guide plate 48. The guide plates 46, 48 and 52 constitute a first introduction passage defining means which works in cooperation with a second introduction passage defining means formed in the opening/closing frame 36 that will be described later. An introduction roller 54 and a feed roller 56 are rotatably mounted in relation to the guide plate 46 between the upright front side plate 38 and the upright rear side plate 42. The upper surfaces of the introduction roller 54 and of the feed roller 56 upwardly protrude beyond the opening formed in the guide plate 46. A rotary shaft 58 that extends substantially horizontally is mounted between the upright front side plate 38 and the upright rear side plate 42. A pair of stopper members 60 are fastened to the rotary shaft 58. The stopper members 60 are disposed on both sides of the introduction roller 54 in the direction of width. A positioning means (not shown) which may be an electromagnetic solenoid is coupled to the rotary shaft 58, and the stopper members 60 are selectively brought by the action of the positioning means to the acting position indicated by a solid line in FIGS. 3 and 4 and to the non-acting position indicated by a two-dot chain line in FIGS. 3 and 4. With the stopper members 60 brought to the acting position, the tips of the stopper members 60 upwardly protrude beyond the opening formed in the guide plate 46 between the introduction roller 54 and the feed roller 56. With the stopper members 60 brought to the non-acting position, the tips of the stopper members 60 descend beneath the guide plate 46. In relation to the guide plate 48, furthermore, a conveyer roller 62 is rotatably mounted between the upright front side plate 38 and the upright rear side plate 42, and a document detector 64 is provided. The conveyor roller 62 leftwardly protrudes in FIGS. 3 and 4 beyond an opening formed in the guide plate 48. The document detector 64 is a reflection-type optical detector, which includes a light-emitting element and a light-receiving element, and detects, through an opening formed at the central portion of the guide plate 48 in the direction of width, the document that is conveyed along the guide plate 48. There are further arranged a pressing roller 66 and a plurality of document detectors 70, 72, 74, 76 and 78 (FIG. 2 shows only one of them) in relation to the guide plate 52. The document detectors 70, 72, 74, 76 and 78, which are the reflection-type optical detectors equipped with light-emitting elements and light-receiving elements, will be described later with reference to FIG. 10. The pressing roller 66 is mounted via a mounting member 80 made of a spring steel and is pressed onto the conveyor roller 62, through the opening formed in the guide plate 52, by the resilient urging action of the mounting member 80. The introduction roller 54 and the feed roller 56 arranged in relation to the guide plate 46 are drivably coupled to a rotary driving source 84 (FIGS 5 and 6), which may be an electric motor, via a transmission means inclusive of an endless belt 82, and are rotated in the counterclockwise direction in FIGS. 3 and 4.

Reference is made to FIGS. 3 and 4 as well as FIGS. 5 and 6. A support shaft 86 that extends substantially horizontally is rotatably mounted between the upper portions of the ends (right ends in FIGS. 3 and 4) of the upright front wall 38 and the upright rear wall 42. A pressing member 88 of nearly an L-shape in cross section is secured to an intermediate portion of the support shaft 86 in the direction of width. A pressing member positioning means 90 constituted by an electromagnetic solenoid is coupled to the rear end of the support shaft 86 (the manner of coupling the support shaft 86 to the pressing member positioning means 90 will be described later). When the electromagnetic solenoid constituting the pressing member positioning means 90 is de-energized, the pressing member 88 is located at the non-acting position indicated by a solid line in FIG. 3 and is upwardly separated away from the introduction roller 54. When the electromagnetic solenoid is energized, the pressing member 88 swings on the support shaft 86 and is brought to the acting position indicated by a two-dot chain line in FIG. 3, and the free end thereof is brought close to or in contact with the introduction roller 54.

Description will be continued with reference to FIGS. 3 to 6. The opening/closing frame 36 disposed between the upright front wall portion 14 and the upright rear wall portion 16 of the frame member 12 includes a main member 92 and a cover member 94. As clearly shown in FIG. 6, the main member 92 includes a guide plate 96 that extends in the direction of width, as well as a front wall plate 98 and a rear wall plate 100 secured to both sides of the guide plate 96. The front upright wall 98 and the rear upright wall 100 are swingably mounted on the support shaft 86. Thus, the main member 92 swings on the center axis of the support shaft 86 between the closed position shown in FIG. 3 and the open position shown in FIG. 4. A notch 102 is formed at an end of the guide plate 96, i.e., at a central portion in the direction of width and at the upstream end in the conveying direction, and the pressing member 88, secured to the support shaft 86, downwardly extends through this notch 102. As shown in FIGS. 3 and 4, a document detector 103 constituted by a microswitch is mounted on the guide plate 96, and the detector arm of the document detector 103, too, downwardly protrudes through the notch 102 (the document detector 103 is not shown in FIGS. 6 and 7). The cover member 94 has an upper surface wall 104 and both end walls 106 and 107 that extend from both ends of the upper surface wall 104. On the upper surface wall 104 of the cover member 94 are formed hanging poles for mounting (not shown) that downwardly extend from both sides thereof in the direction of width. The cover member 94 is detachably attached to the main member 92 by setscrews (not shown) that are fitted to the hanging poles from the lower sides thereof through the guide plate 96 of the main member 92.

Figure 7:
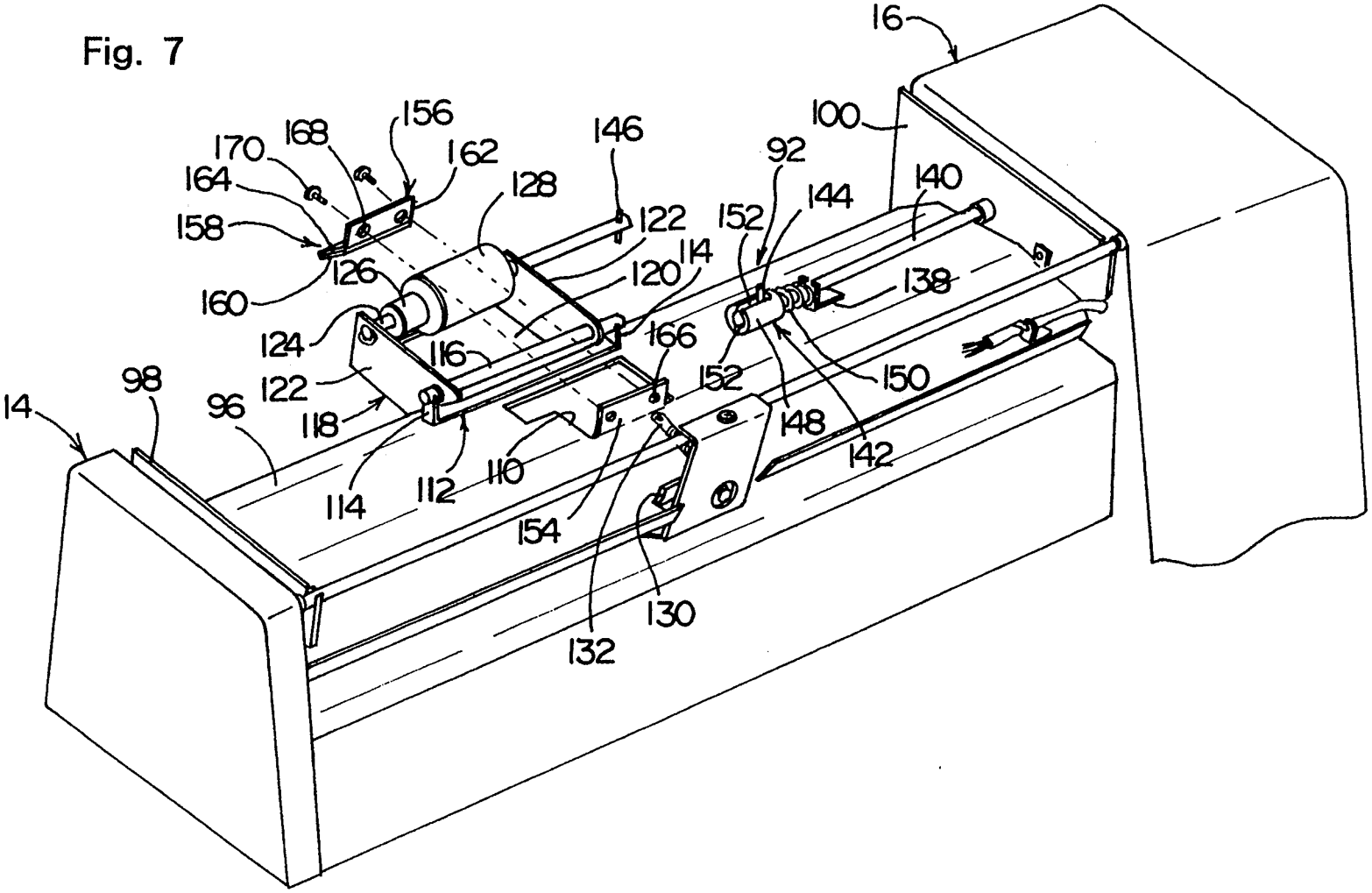
FIG. 7 is a partial perspective view showing in a disassembled manner a portion of the automatic document conveying device of FIG. 1 under the situation where the cover of the opening/closing frame is removed and a separation roller support bracket is brought to the non-acting position.

The guide plate 96 of the main member 92 in the opening/closing frame 36 constitutes a second introduction passage defining means that works in cooperation with said first introduction passage defining means (guide plates 46, 48 and 52) in the main frame 10. That is, when the opening/closing frame 36 is brought to the closed position shown in FIG. 3, the guide plate 96 of the main member 92 is positioned opposed to the guide plate 46 thereby to define an upstream portion of the document introduction passage 108 therebetween. The downstream portion of the document introduction passage 108 is defined between the guide plate 48 and the guide plate 52 in the main frame 10. In FIGS. 6 and 7, an opening 110 is formed in the guide plate 96 of the main member 92 in the opening/closing frame 36 at a portion opposed to the feed roller 56. A mounting bracket 112 is secured onto the guide plate 96 on the downstream side of the opening 110. The mounting bracket 112 has a pair of mounting pieces 114 that upwardly extend at a distance in the direction of width, and a short shaft 116 that extends substantially horizontally is rotatably mounted between the mounting pieces 114. A support bracket 118 is mounted on the short shaft 116. The support bracket 118 has a flat upper surface wall 120 and two side walls 122 that hang from sides in the direction of width of the upper surface wall 120. Both side walls 122 are fitted to the short shaft 116 at the ends on one side thereof. Thus, the support bracket 118 swings on the center axis, i.e., center swing axis, of the short shaft 116 between the acting position shown in FIG. 6 and the non-acting position shown in FIG. 7. When the support bracket 118 is brought to the open position shown in FIG. 7, the edges of both side walls 122 of the support bracket 118 come in contact with the upper surface of the guide plate 96, and the support bracket 118 is prevented from swinging beyond the open position in the counterclockwise direction as viewed from the front. A separation roller support shaft 124 that extends substantially horizontally is rotatably mounted at the other ends of both side walls 122. A separation roller 128 is fitted to the support shaft 124 via a torque limiter 126 that limits the transmission torque to a predetermined value. It is desired that the separation roller 128 is made of a suitable synthetic rubber. A protrusion 130 is formed to protrude upwards at the upstream end of the guide plate 96 adjacent to the notch 102 but on the downstream side thereof. A threaded shaft 132 is inserted in the protrusion 130. A nut 134 is fitted to the base end of the threaded shaft 132 (portion on the upstream side of the protrusion 130), and the threaded shaft 132 is limited by the nut 134 from moving toward the downstream side. An end of a pulling coiled spring member 136 that constitutes a resiliently urging means is detachably connected to a tip of the threaded shaft 132, and the other end of the spring member 136 is detachably connected to the support bracket 118. When the support bracket 118 is brought to the acting position shown in FIGS. 3, 5 and 6 and the spring member 136 is stretched between the threaded shaft 132 and the support bracket 118, the spring member 136 resiliently urges the support bracket 118 in the clockwise direction in FIG. 3, whereby the separation roller 128 is resiliently pressed onto the feed roller 56.

With further reference to FIGS. 6 and 7, a mounting bracket 138 is secured onto the guide plate 96 at the rear of the opening 110 formed in the guide plate 96, and a driven shaft 140 is rotatably mounted between the mounting bracket 138 and the rear wall plate 100 of the main member 92. When the support bracket 118 is brought to the acting position shown in FIG. 6, the support shaft 124 is detachably connected to the driven shaft 140 via a joint means 142. The illustrated joint means 142 is constituted by a pin joint which is known per se., and includes a connection pin 144 secured to the output end of the driven shaft 140, a connection pin 146 secured to the input end of the support shaft 124, a connection sleeve 148 fitted to the output end of the driven shaft 140 and capable of moving in the axial direction, and a compression coiled spring member 150 interposed between the connection sleeve 148 and the mounting bracket 138. The spring member 150 resiliently urges the connection sleeve 148 toward the inner side. A pair of slits 152 are formed in the connection sleeve 148 extending in the axial direction from the inner end thereof, and the closed end of the slit 152 comes in contact with the connection pin 144 to restrict the connection sleeve 148 from moving toward the inner side. The input end of the support shaft 124 is inserted in the connection sleeve 148 (at this moment, the connection sleeve 148 is slightly moved outwards against the resiliently urging action of the spring member 150), the connection pin 146 secured to the input end of the support shaft 124 is received by the slit 152 of the connection sleeve 148 and thus, the driven shaft 140 is connected to the support shaft 124 via connection pin 144, connection sleeve 148 and connection pin 146. The driven shaft 140 is coupled, via a transmission gear (not shown), to a support shaft (not shown) to which the feed roller 56 is secured and is, hence, coupled to the rotary driving source 84 to be rotated in the counterclockwise direction in FIG. 3. The revolution of the driven shaft 140 is transmitted to the separation roller 128 via torque limiter 126, and the separation roller 128 is rotated in the counterclockwise direction in FIG. 3.

With reference to FIGS. 6 and 7, a protrusion 154 is formed on the guide plate 96 of the main member 92 in the opening/closing frame 36 to upwardly protrude from the upstream side edge of the opening 110. A restriction member 156 is mounted on the protrusion 154. The restriction member 156 is constituted by a rigid metal plate 158 such as a stainless steel and a synthetic rubber plate 160. The metal plate 158 has a mounting portion 162 that extends nearly perpendicularly and a support portion 164 that extends downwardly tilted in the downstream direction from the lower end of the mounting portion 162. The synthetic rubber plate 160 is stuck to one surface, i.e., the lower surface, of support portion 164 of the metal plate 158. Two threaded holes 166 are formed in the protrusion 154 at a distance from each other in the direction of width. Two holes 168 are formed in the mounting portion 162 of the metal plate 158 to correspond to the threaded holes 166. The holes 168 are slightly elongated in the up-and-down direction. Setscrews 170 are fitted to the threaded holes 166 through the holes 168, so that the restriction member 156 is secured to the protrusion 154 in such a manner that its position can be adjusted. The restriction member 156 downwardly extends through the opening 110 formed in the guide plate 96, and its front end is located close to the feed roller 56 as shown in FIG. 3. As will be described later, the document to be conveyed is introduced between the restriction member 156 and the feed roller 56. Here, however, it is desired that the document does not come in contact with the metal plate 158 but is permitted to come in contact with the synthetic rubber plate 160 only. The document that comes in contact with the front end or corners of the metal plate 158 is often damaged by burrs or sharp corners that are formed at the time of cutting the metal. The restriction member 156 is provided to prevent a plurality of pieces of documents (e.g., three or more pieces of documents) from being simultaneously introduced between the feed roller 56 and the separation roller 128. Here, in order for the restriction member 156 to very reliably execute the desired function, the front end of the restriction member 156 must be held at a required position very accurately with respect to the feed roller 56, and moreover, the front end of the restriction member 156 must be maintained at the required position very stably without easily undergoing movement even in case the document comes into collision with the restriction member 156. In order to satisfy such requirements, it is important that the metal plate 158 and the synthetic rubber plate 160 are laminated to constitute the restriction member 156 and that the front end of the synthetic rubber plate 160 disposed on the lower surface of support portion 164 of the metal plate 158 is positioned substantially in match with or slightly at the back of the front end of the metal plate 158. As will be clearly understood with reference to FIG. 3, the document introduced between the restriction member 156 and the feed roller 56 comes in contact with the synthetic rubber plate 160 only but is very reliably inhibited from coming into contact with the metal plate 158. In addition, even when the document comes into relatively strong collision with the synthetic rubber plate 160, the front end of the synthetic rubber plate 160 does not undergo displacement but can be maintained at the required position very reliably since the synthetic rubber plate 160 is supported by the rigid metal plate 158. The synthetic rubber plate 160 may be made of a suitable synthetic rubber material having a JIS-A hardness of from about 60 to about 80, such as the one produced by Toyo Rubber Industries Co. in the trade name of S-7116. The synthetic rubber plate 160 may have a thickness of about 1 mm to about 3 mm.

Attention should be given to the following facts concerning the separation roller 128 and the restriction member 156. That is, after they are used repetitively for long periods of time, the separation roller 128 made of a synthetic rubber is worn out and must be replaced, as is widely known among people skilled in the art. Similarly, the synthetic rubber plate 160 of the restriction member 156, too, is worn out after repetitive use for long periods of time, and must be replaced. In the illustrated embodiment of the automatic document conveying device constituted according to the present invention, it is possible to replace the separation roller 128 and the restriction member 156 very easily compared with the conventional automatic document conveying devices. First, the cover member 94 of the opening/closing frame 36 is removed from the main member 92 (at this moment, the opening/closing frame 36 is brought to the open position shown in FIG. 4, the cover member 94 is removed by unscrewing the setscrews that have been fitted to the hanging poles of the cover member 94 through guide plate 96 of the main member 92, and the opening/closing frame 36 from which the cover member 94 is removed is returned back to the closed position shown in FIG. 3). Then, as will be easily comprehended from FIG. 3 as well as FIGS. 5 and 6, the support bracket 118 on which the separation roller 128 is mounted is exposed to view. Further, a portion where the support shaft 124 is connected to the driven shaft 140, i.e., joint means 142, and a portion where the support bracket 118 and the spring member 136 are connected together (as well as a portion where the spring member 136 and the threaded shaft 132 are connected together) are exposed to view. Then, the spring member 136 is disconnected from the support bracket 118 (or, instead, the spring member 136 is disconnected from the threaded shaft 132). And, the joint means 142 is operated to separate the support shaft 124 on which the separation roller 128 is mounted from the driven shaft 140. Thereafter, the support bracket 118 is turned to the open position shown in FIG. 7. Thus, the separation roller 128 and the support shaft 124 on which the separation roller 128 is mounted are exposed to view, enabling the separation roller 128 to be replaced very easily. Moreover, a portion where the restriction member 156 is mounted on the protrusion 154 is exposed to view, enabling the restriction member 156 to be replaced very easily. During the operation of replacement, it is possible to see the front end of the restriction member 156 and the feed roller 56 adjacent thereto through the opening 110 that is formed in the guide plate 96 and, hence, to place the restriction member 156 at the required position very accurately and easily.

Figure 8:
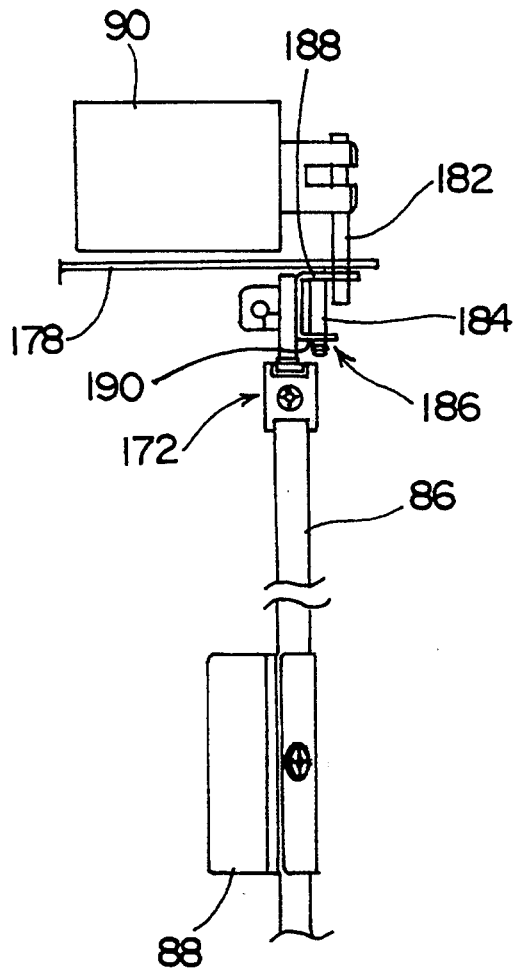
FIG. 8 is a partial plan view illustrating the manner of coupling a pressing member to a positioning means thereof in the automatic document conveying device of FIG. 1.

The manner of coupling the above-mentioned pressing member 88 to the pressing member positioning means 90 will now be described with reference to FIG. 6 as well as FIGS. 8 and 9. The rear end of the support shaft 86 to which the pressing member 88 is secured protrudes rearwardly beyond the upright rear side plate 42. A coupler 172 is secured to the rear end of the support shaft 86. The coupler 172 has a hanging portion 174 that extends downwardly, and a contacting piece 176 constituted by a pin that rearwardly extends is secured to the hanging portion 174. An upright support wall 178 is arranged at the back of the upright rear side plate 42, and an electromagnetic solenoid that constitutes the pressing member positioning means 90 is mounted on the back surface of the support wall 178. To the output terminal of the electromagnetic solenoid that constitutes the pressing member positioning means 90 is fastened a pin 182 that inwardly protrudes through an elongated slit 180 formed in the support wall 178. To the support wall 178 is secured a short shaft 184 that inwardly extends substantially horizontally above the slit 180, and an operation member 186 is rotatably mounted on the short shaft 184. The operation member 186 has a pair of mounting portions 188 and 190 (the short shaft 184 extends passing through openings formed in the mounting portions 188 and 190), one mounting portion 188 being downwardly protruded and having the pin 182 rotatably coupled to the protruded end thereof. Further, the operation member 186 has a pair of contact pieces, i.e., a first contact piece 192 and a second contact piece 194, that upwardly protrude between the pair of mounting portions 188 and 190. As will be clearly understood from FIG. 9, the first contact piece 192 and the second contact piece 194 extend at an angle of about 30 degrees apart with respect to each other. The support wall 178 has a protrusion 196 that inwardly protrudes, and a pulling coiled spring 198 is stretched between the protrusion 196 and the mounting portion 190 of operation member 186. When the electromagnetic solenoid is de-energized, the operation member 186 is brought to an angular position indicated by a solid line in FIG. 9 due to the resiliently urging action of the spring member 198. Under this condition, the second contact piece 194 of the operation member 186 acts on the contacting piece 176, and the pressing member 88 is brought to the non-acting position (indicated by a solid line in FIG. 3) which is upwardly separated from the introduction roller 54. When the electromagnetic solenoid is energized and retracts its output terminal, the operation member 186 is brought to the angular position indicated by a two-dot chain line in FIG. 9 against the resiliently urging action of the spring member 198. Under this condition, the first contact piece 192 of the operation member 186 acts on the contacting piece 176, and the pressing member 88 is brought to the acting position (indicated by two-dot chain line in FIG. 3) where the free end thereof is brought close to or in contact with the introduction roller 54.

Figure 9:
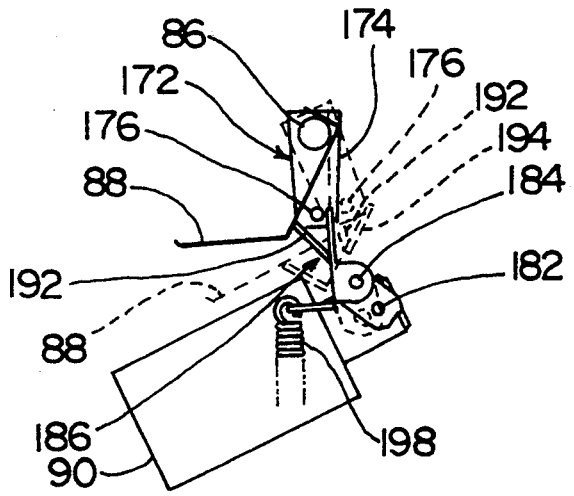
FIG. 9 is a schematic side view illustrating the manner of coupling the pressing member to the positioning means thereof in the automatic document conveying device of FIG. 1.

With reference to FIG. 9 together with FIGS. 3 and 4, when the document is jammed in the document introduction passage 108, the opening/closing frame 36 is made to be turned from the closed position shown in FIG. 3 to the open position shown in FIG. 4 thereby to open the document introduction passage 108. In the automatic document conveying device 2 constituted according to the present invention, however, when the opening/closing frame 36 is turned from the closed position to the open position, the lower end of end wall 107 of the cover member 94 comes in contact with the pressing member 88, and the pressing member 88 is turned in the clockwise direction in FIGS. 3 and 4 from the non-acting position through up to the retracted position shown in FIG. 4 with the turn of the opening/closing frame 36. Here, it is important that the first contact piece 192 of the operation member 186 does not interfere the contacting piece 176 and that the pressing member 88 is not hindered from turning. For this purpose, the construction is so made that the contacting piece 176 is not interrupted by the first contact piece 192 of the operation member 186 but is allowed to turn in the clockwise direction in FIG. 9 under the condition where the electromagnetic solenoid constituting the pressing member positioning means 90 is de-energized, the operation member 186 is located at an angular position indicated by a solid line in FIG. 9 and the pressing member 88 is located at the non-acting position indicated by a solid line in FIG. 3. When the pressing member 88 is turned to the retracted position shown in FIG. 4 as described above, the pressing member 88 is sufficiently separated from the introduction roller 54. Therefore, the document does not come in contact with the pressing member 88 and is not damaged. It is thus possible to remove the jammed documents from the document introduction passage 108 very easily.

Figure 10:
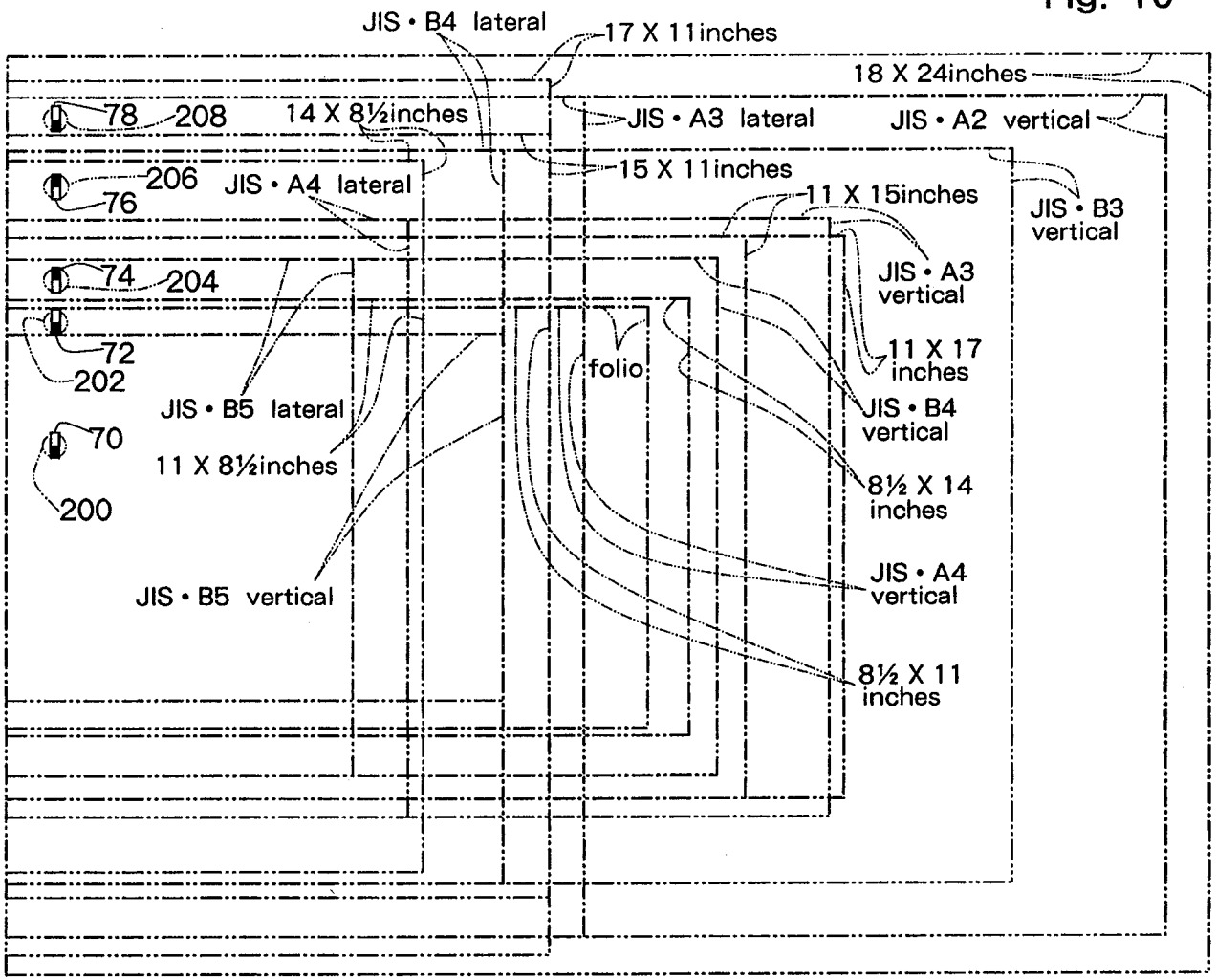
FIG. 10 is a schematic diagram illustrating a plurality of document detectors arranged in alignment in the direction of width in the automatic document conveying device of FIG. 1, together with documents of various sizes.

FIG. 10 shows the arrangement of the document detectors 70, 72, 74, 76 and 78 that are disposed in the downstream portion of the document introduction passage 108. With reference to FIGS. 10 as well as 3, the guide plate 52 has five circular openings 200, 202, 204, 206 and 208 that are in alignment in the direction of width (up-and-down direction in FIG. 10). The document detectors 70, 72, 74, 76 and 78 are disposed being corresponded to the circular openings 200, 202, 204, 206 and 208. Each of the document detectors 70, 72, 74, 76 and 78 is constituted by a reflection type optical detector equipped with a light-emitting element and a light-receiving element. In FIG. 10, the light-emitting elements are indicated by white squares and the light-receiving elements are indicated by black squares for convenience. As will be clearly understood from FIG. 10, the document detectors 70, 72, 74, 76 and 78 are arranged substantially in alignment in the direction of width. In the document detectors 70, 72, 74, 76 and 78, the light-receiving elements and the light-emitting elements are arranged in parallel not in the direction of conveying documents, but in the direction of width. In addition, in the document detectors adjacent to each other, the light-receiving element and the light-emitting element are arranged in the opposite directions relative to each other. In the document detector 72, for instance, the light-receiving element is disposed on the inside in the direction of width and the light-emitting element is disposed on the outside in the direction of width in parallel with each other. In the neighboring document detector 74, on the other hand, the light-emitting element is disposed on the inside in the direction of width and the light-receiving element is disposed on the outside in the direction of width in parallel with each other. In the document detectors 70, 72, 74, 76 and 78, the light-emitting elements project light to the document introduction passage 108 through openings 200, 202,204, 206 and 208, and the document is detected by the light-receiving elements which receive light that is reflected by the document passing through the document introduction passage 108 and that passes through the openings 200, 202, 204, 206 and 208. In the illustrated automatic document conveying device 2, the document is conveyed with its center in the direction of width in agreement with the center of the document introduction passage 108 in the direction of width (a so-called center-reference conveyance). In FIG. 10, two-dot chain lines indicate documents of various standards or predetermined sizes used in Japan and in foreign countries that can be conveyed through the document conveying passage 108. The sizes in the direction of width of the documents passing through the document introduction passage 108 can be classified into six kinds depending upon how many of the five document detectors 70, 72, 74, 76 and 78 have detected the document. In addition, the length of the document in the conveying direction is detected by measuring the time from a moment at which the leading end of the document is detected by the document detector 70 until the trailing end of the document passes through the document detector 70 (i.e., until the document detector 70 does not detect the document any longer). Accordingly, twenty different document sizes can be discriminated as shown in FIG. 10 by detecting five different sizes in the direction of width of the document and the length of the document in the conveying direction.

Attention should be given to the following facts concerning the above-mentioned document detectors 70, 72, 74, 76 and 78. That is, the size of the document introduction passage 108 in the direction of width is determined according to the maximum size of document in the direction of width which requires usually considerably large space, large enough for arranging a plurality of document detectors 70, 72, 74, 76 and 78 in the direction of width. On the other hand, the size in the direction of conveying the document is desired to be as small as possible from the standpoint of constructing the whole device in a compact size. In the illustrated automatic document conveying device constituted according to the present invention, a plurality of document detectors 70, 72, 74, 76 and 78 are arranged in alignment in the direction of width, and the light-emitting elements and the light-receiving elements in each of the document detectors 70, 72, 74, 76 and 78 are arranged in parallel in the direction of width. Therefore, the length required for arranging the document detectors 70, 72, 74, 76 and 78 in the conveying direction can be reduced to the size of a single light-emitting element which is a minimum size in the conveying direction (or the size of a single light-receiving element in the conveying direction). When the two neighboring document detectors are located very close to each other in the direction of width, the light projected from the light-emitting element of one document detector and then reflected by the document may be received by the light-receiving element of the other document detector due to irregular reflection. This might cause erroneous detection if the light-receiving element and the light-emitting element of the two document detectors are arranged in parallel in the same order in the direction of width. In the two neighboring document detectors, e.g., in the document detectors 72 and 74 of the automatic document conveying device according to this invention, however, the light-emitting element and the light-receiving element are arranged in parallel in an opposite order as shown in FIG. 10. Thus, the light-emitting element of one document detector is sufficiently separated away from the light-receiving element of the other document detector, making it possible to reliably avoid the occurrence of the above-mentioned erroneous detection.

Figure 11:
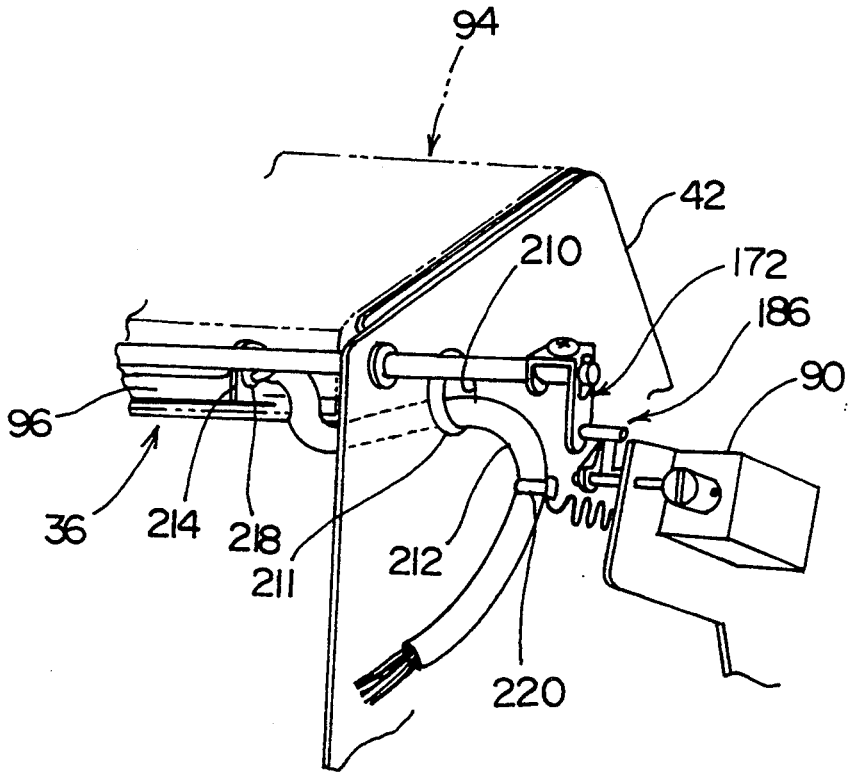
FIG. 11 is a partial perspective view showing the rear end of the opening/closing frame of the automatic document conveying device of FIG. 1 together with the rear side plate of the main frame.
Figure 12:
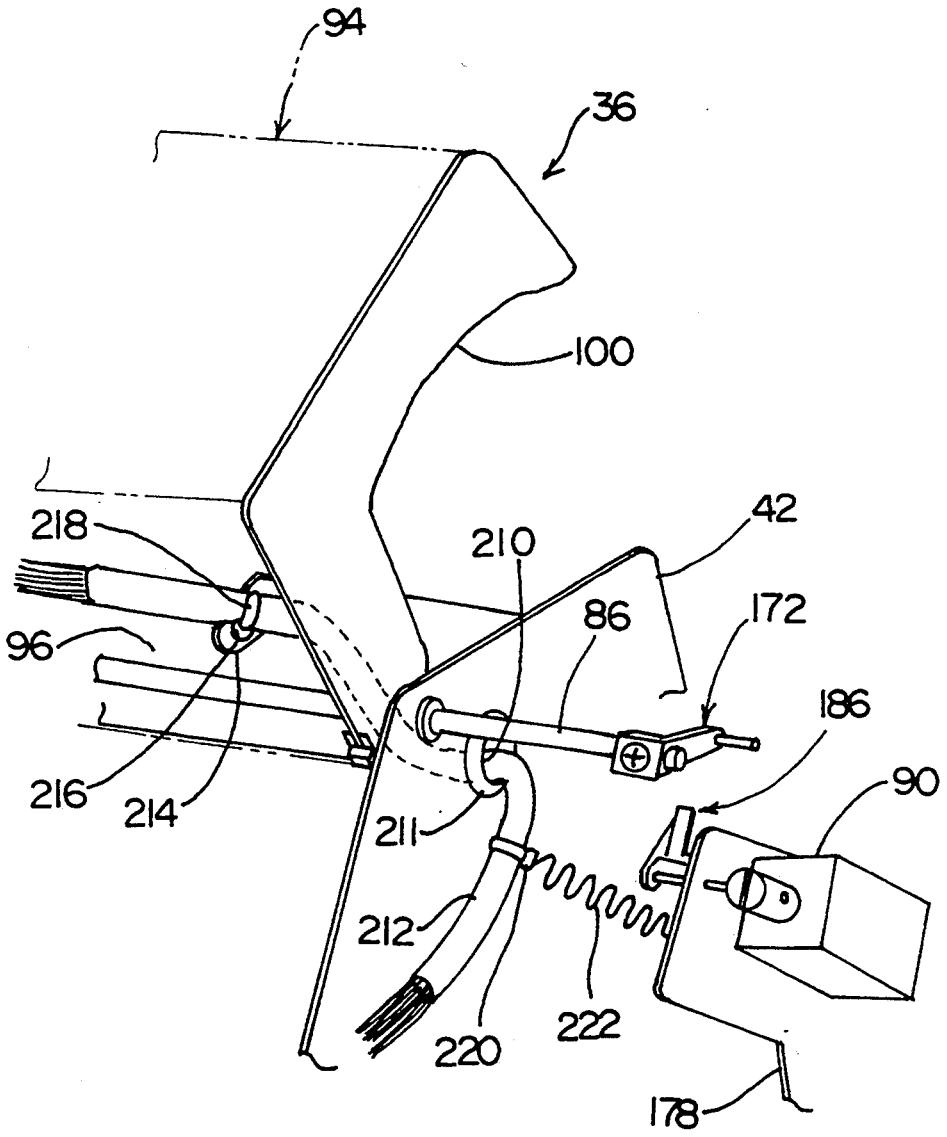
FIG. 12 is a partial perspective view, like that of FIG. 11, showing the rear end of the opening/closing frame of the automatic document conveying device of FIG. 1 together with the rear side plate of the main frame under the situation where the opening/closing frame is brought to the open position.

With reference to FIG. 6 as well as FIGS. 11 and 12, a circular opening 210 is formed in the upright rear side plate 42 of the frame member 12. The opening 210 is displaced slightly downwardly and toward the downstream side with respect to the swing axis of the opening/closing frame 36. A ring 211 which is desirably made of a synthetic resin or a synthetic rubber is fitted to the opening 210. A soft tube 212 which may, for example, be a vinyl chloride tube is inserted in the opening 210, more specifically, the ring 211 fitted thereto. This tube 212 contain many electric wires. The electric wires are connected to the electric elements such as document detectors 64, 70, 72, 74, 76, 78 and 103 (FIGS. 3 and 10) on the inside of the upright rear side plate 42, and are connected to a control circuit and a power source circuit (not shown) on the outside (rear side) of the upright rear side plate 42. As clearly shown in FIG. 6, the tube 212 extends on the guide plate 96 of the main member 92 from the opening 210 passing through the lower or upstream side of the rear wall plate 100 of the main member 92 in the opening/closing frame 36. A fixed bracket 214 is secured to the upper surface of the guide plate 96. The fixed bracket 214 has an upwardly directed protrusion that has a hole 216 formed therein. The tube 212 is fitted to the hole 216 of the fixed bracket 214 by a bundling fitting 218. The bundling fitting 218 bundles many electric wires that extend running in the tube 212 and the tube 212 together so that the tube 212 and the electric wires will not move relative to each other at the bundled position, and further bundles the tube 212 and the electric wires to the fixed bracket 214 so that the tube 212 and the electric wires will not move relative to the fixed bracket 214 at the bundled position. As the bundling fitting 218, there can be favorably used a bundling fitting that is manufactured by Kitakawa Kogyo Co. and is placed in the market in the trade name of "SK Binder". The tube 212 containing many electric wires also extends outwardly (rearwardly) through the opening 210 formed in the upright rear side plate 42 and is bundled by a bundling fitting 220 at a position a predetermined distance (e.g., about 4 to about 6 cm) from the opening 210. The bundling fitting 220 may be the same as the bundling fitting 218, and bundles many electric wires running in the tube 212 and the tube 212 together to prevent the tube 212 and the electric wires from moving relative to each other at the bundled position. An end of a pulling coiled spring member 222 is connected to the bundling fitting 220, and the other end of the spring member 222 is connected to the upright support wall 178. The spring member 222 resiliently urges the tube 212 and the electric wires running therein rearwardly, i.e., toward a direction away from the opening 210.

When the opening/closing frame 36 is turned between the closed position shown in FIG. 11 (and FIG. 3) and the open position shown in FIG. 12 (and FIG. 4), there occurs a change in the distance between the opening 210 and the position at which the tube 212 is fastened to the opening/closing frame 36 (i.e., the bundling position by the bundling fitting 218) with the turn of the opening/closing frame 36, since the opening 210 is displaced from the swing axis (center axis of support shaft 86) of the opening/closing frame 36. The distance is relatively short when the opening/closing frame 36 is at the closed position shown in FIG. 11 and is relatively long when the opening/closing frame 36 is at the open position shown in FIG. 12. When the opening/closing frame 36 is at the closed position shown in FIG. 11 and the distance is relatively short, the tube 212 is resiliently pulled out toward the outside of the opening 210 by the resiliently pulling action of the spring member 222. When the opening/closing frame 36 is turned to the open position shown in FIG. 12 and the distance becomes relatively long, the spring member 222 is resiliently elongated correspondingly, and the tube 212 is pulled in toward the inside of the opening 210 by a predetermined length. The tube 212 and the electric wires running therein are pulled out or pulled in through the opening 210 depending upon a change in the distance caused by the opening or closure of the opening/closing frame 36. Therefore, the tube 212 and the electric wires are reliably prevented from being excessively slackened near the opening 210, and are further reliably prevented from being bit between the upright rear side plate 42 and the rear wall plate 100 of the opening/closing frame 36. Moreover, the tube 212 and the electric wires are reliably prevented from receiving excessively tensile force formed at the turning of the opening/closing frame 36, and are hence reliably prevented from being broken or damaged.

In the illustrated embodiment, the bundling by the bundling fitting 218 on the inside of the opening 210 is secured at a predetermined position of the opening/closing frame 36, and the bundling by the bundling fitting 220 on the outside of the opening 210 is resiliently urged by the spring member 222 toward the direction to separate away from the opening 210. Contrary to the above, however, it is also allowable to fix the bundling by the bundling fitting 220 on the upright rear side plate 42 via a suitable bracket on the outside of the opening 210, and resiliently urge the bundling by the bundling fitting 218 using a suitable spring member inwardly, i.e., toward the direction to separate away from the opening 210 on the inside of the opening 210. Even in this case, the tube 212 and the electric wires are suitably pulled out or pulled in through the opening 210 depending upon a change in the distance between the opening 210 and a portion where the tube 212 and the electric wires are fastened to the upright rear side plate 42 on the outside of the opening 210, caused by the turn of the opening/closing frame 36. Therefore, the tube 212 and the electric wires are reliably prevented from being excessively slackened near the opening 210, and are further reliably prevented from receiving excessive tensile force.

Figure 13:
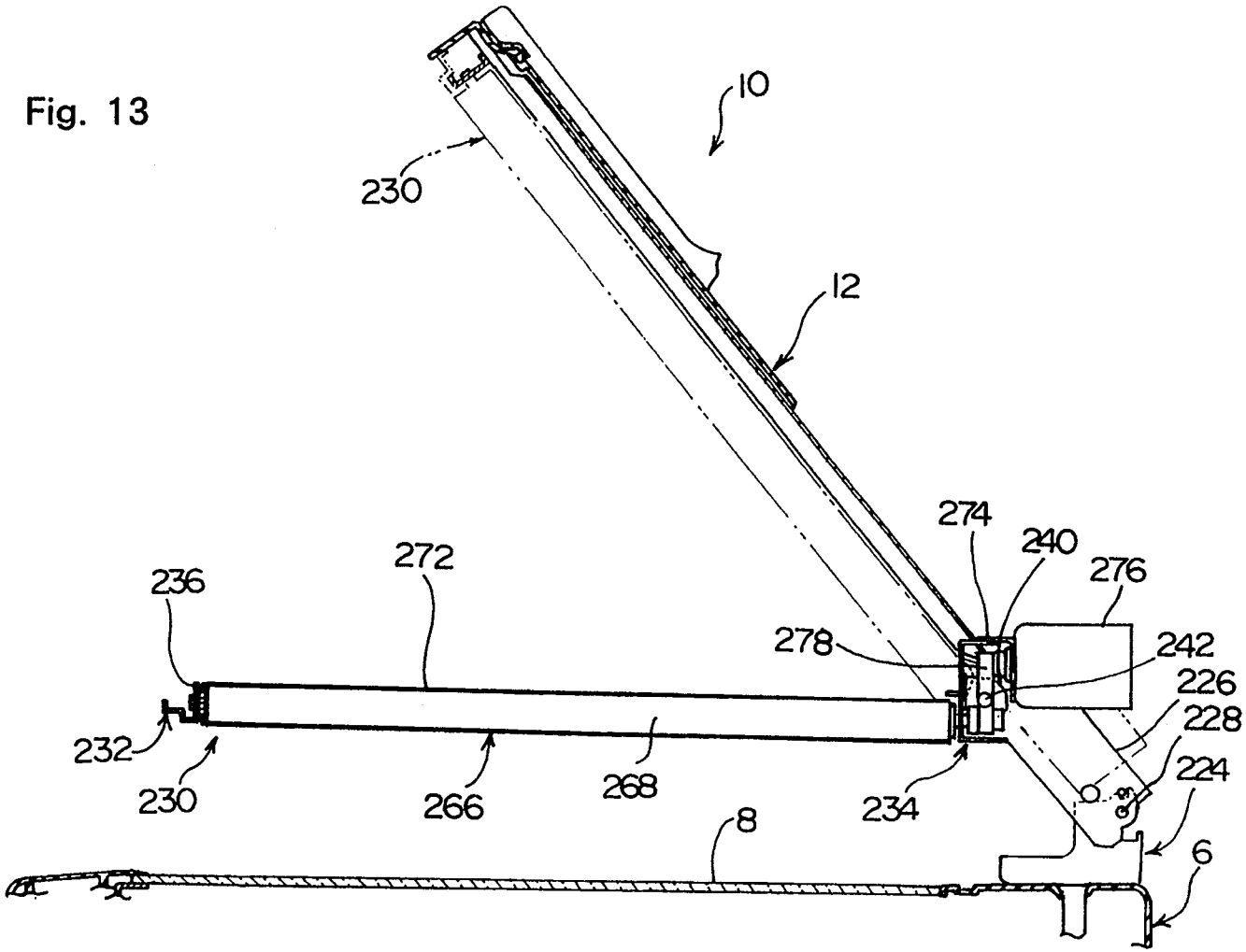
FIG. 13 is a sectional view illustrating a swing frame and a conveyer belt mechanism mounted thereon in the automatic document conveying device of FIG. 1.

With reference to FIGS. 1 and 2 together with FIG. 13, a pair of mounting mechanisms 224 (FIG. 13 illustrates only one of them) are arranged at the upper rear edge of the housing 6 of the electrostatic copying machine 4 at a distance in the conveying direction (in the right-and-left direction in FIG. 2, or in a direction perpendicular to the surface of paper in FIG. 13). Furthermore, a pair of base plates 226 (FIG. 13 shows only one of them) are arranged on the rear portion of the frame member 12 in the main frame 10 of the automatic document conveying device 2 at a distance in the conveying direction, and are rotatably mounted on the mounting mechanisms 224 via a support shaft 228. Thus, the main frame 10 of the automatic document conveying device 2 is rotatably mounted to turn on the center axis of the support shaft 228 between the closed position shown in FIGS. 1 and 2 and the open position shown in FIG. 13. The support shaft 226, i.e., the swing axis of the main frame 10, extends substantially horizontally along the rear edge of the transparent plate 8. The mounting mechanism 224 itself may be a known one and, hence, its constitution is not described here in detail.

Figure 14:
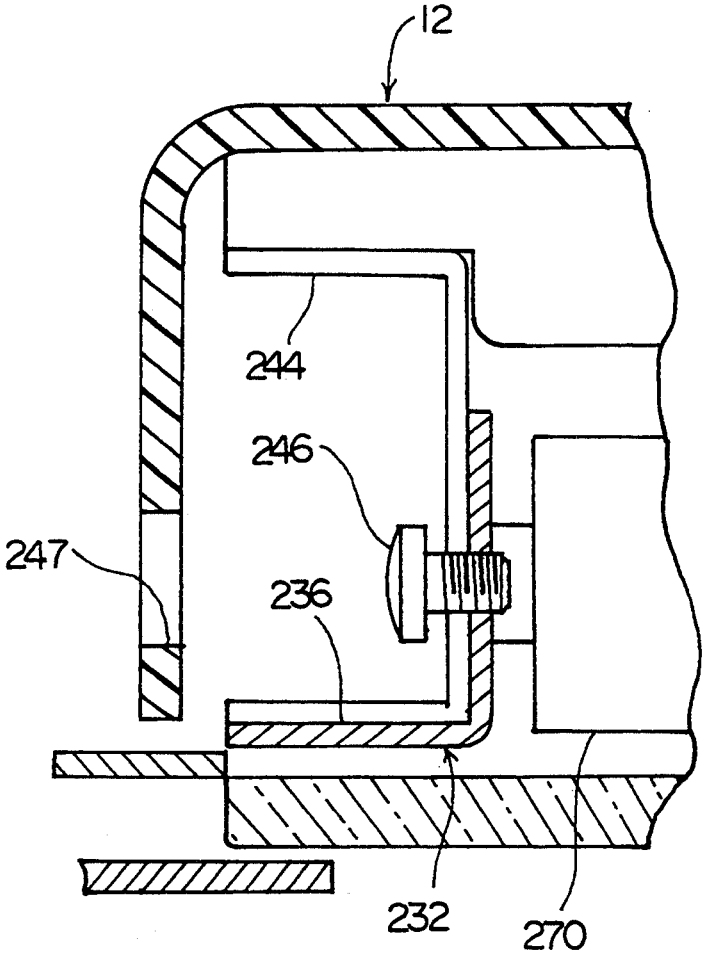
FIG. 14 is a partial sectional view illustrating the manner of coupling the swing frame to the main frame in the automatic document conveying device of FIG. 1.

A swing frame 230 is mounted in the frame member 12 which is nearly of the shape of a box having an open lower surface. The swing frame 230 has a pair of support means, i.e., a front support means 232 and a rear support means 234, arranged at a predetermined distance in the direction of width (direction perpendicular to the support shaft 228). The front support means 232 is constituted by a first support member 236 and a second support member 238 (see FIG. 13 as well as FIGS. 14 and 15). The first support member 236 extends in an elongated shape in the conveying direction and has a main portion of nearly an L-shape in cross section. The second support member 238 has the shape of a strap extending in the conveying direction following the first support member 236 (the relationship between the first support member 236 and the second support member 238 will be described later in detail). The rear support means 234 is constituted by a member which extends in an elongated form in the conveying direction and has the shape of a channel in cross section with its rear surface open. A plurality of coupling members (not shown) extend between the front support means 232 and the rear support means 234. A pair of mounting brackets 240 (FIG. 13 shows only one of them) are secured to the rear support means 234 at a distance in the conveying direction, and are rotatably mounted on the pair of base plates 226 of the frame member 12 via a support shaft 242. Thus, the swing frame 230 is mounted to swing on the center axis of the support shaft 242 between a coupling position indicated by a two-dot chain line in FIG. 13 and a separated position indicated by a solid line in FIG. 13. As the swing frame 230 is brought to the above separated position, the rear support means 234 comes into contact with the contact piece (not shown) formed on the base plate 226 of the frame member 12, and the swing member 230 is prevented from swinging beyond the separated position in the counterclockwise direction in FIG. 13 with respect to the frame member 12. As clearly shown in FIG. 14, a pair of coupling members 244 (FIG. 14 shows only one of them) are secured to the front edge of the frame member 12 at a distance in the conveying direction. As the swing frame 230 is brought to the coupling position, the coupling member 244 is located adjacent to the first support member 236 in the first support means 232 in the swing frame 230. A plurality of setscrews 246 (FIG. 14 shows only one of them) are screwed into the first support member 236 via the coupling member 244 in order to detachably couple the swing frame 230 to the frame member 12 at the coupling position. Openings 247 are formed in the front wall of the frame member 12 in correspondence to the setscrews 246 for the purpose of easy manipulation of the setscrews 246 that constitute coupling means for detachably coupling the swing frame 230 to the frame member 12.

Figure 15:
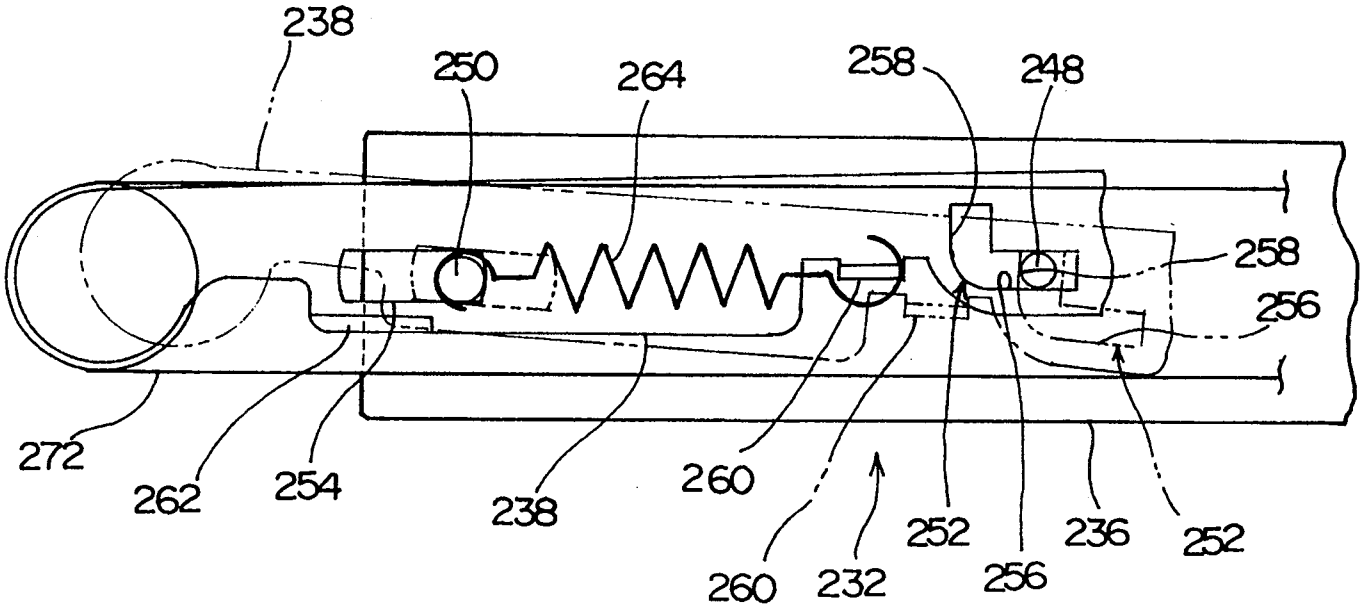
FIG. 15 is a front view showing a portion of a front support means in the conveyer belt mechanism in the automatic document conveying device of FIG. 1.

With reference to FIG. 13 together with FIG. 15, two forwardly protruding pins 248 and 250 are secured to one end (left end in FIG. 15) of the first support member 236 in the front support means 232 while being spaced in the conveying direction (right-and-left direction in FIG. 15). Furthermore, two slits 252 and 254 are formed in the second support member 238 in the front support means 232 while being spaced in the conveying direction. The slit 252 extends nearly in an L-shape and has a guide portion 256 that extends in the lateral direction and an anchoring portion 258 that extends in the up-and-down direction. The slit 254 has nearly a rectangular shape that extends oblongly in the lateral direction. The second support member 238 further has a forwardly protruded hooked portion 260 and a forwardly protruded grip protrusion 262. As shown in FIG. 15, the second support member is positioned on the front side of the first support member 236, and the pins 248 and 250 of the first support member 236 are inserted in the slits 252 and 254 of the second support member 238, thereby to couple the first support member 236 to the second support member 238. A resiliently urging means 264 constituted by a pulling coiled spring member is stretched between the pin 250 of the first support member 236 and the hooked portion 260 of the second support member 238. The resiliently urging means 264 resiliently urges the second support member 238 leftwardly in FIG. 15 in order to maintain the endless belt of the conveyer belt mechanism (that will be described later) under the tensioned condition (in this case, the pin 248 of the first support member 236 is positioned in the guide portion 256 in the slit 252 of the second support member 238). On the other hand, the grip protrusion 262 of the second support member 238 may be gripped to forcibly move the second support member 238 rightwardly in FIG. 15 against the urging action of the resiliently urging means 264 and to bring the pin 248 of the first support member 236 in the anchoring portion 258 in the slit 252 of the second support member 238 as indicated by a two-dot chain line in FIG. 15. Then, the pin 248 is brought into engagement with the anchoring portion 258 of the slit 252, and the second support member 238 is releasably and temporarily anchored at a non-tensioned position indicated by a two-dot chain line in FIG. 15 (thus, the anchoring portion 258 of the slit 252 and the pin 248 constitute an anchoring means which releasably anchors the second support member 238 at the non-tensioned position).

With reference to FIGS. 2 and 13, a belt conveyer mechanism 266 is mounted on the swing frame 230. The conveyer belt mechanism 266 includes a pair of belt rollers, i.e., a driven belt roller 268 and a follower belt roller 270 that are spaced in the conveying direction (i.e., in the direction of swing axis of the swing frame 230), and an endless belt 272 wrapped round the driven belt roller 268 and the follower belt roller 270. The driven belt roller 268 is rotatably mounted between the rear support means 234 and the first support member 236 of the front support means 232. The follower belt roller 270 is rotatably mounted between the rear support means 234 and the second support member 238 of the front support means 232. The rear end of the follower belt roller 270 is rotatably mounted on the rear support means 234, and is movable in the conveying direction, and is resiliently urged leftwards in FIGS. 2 and 15 by a suitable spring member (not shown). Therefore, the front end as well as the rear end of the follower belt roller 270 are resiliently urged leftwards in FIGS. 2 and 15, and the endless belt 272 is maintained under the required tensioned condition. As shown in FIG. 13, a support bracket 274 is secured to the rear support means 234 of the swing frame 230, and a rotary drive source 276 which may be an electric motor is mounted on the support bracket 274. The output shaft of the rotary drive source 276 is drivably coupled to the driven belt roller 268 via a transmission train including a transmission belt 278. Therefore, the conveyer belt mechanism is rotatably driven in a predetermined direction by the rotary drive source 276. As shown in FIG. 2, the conveyer belt mechanism 266 includes a plurality of pressing rollers 280 which may be of a known form. In FIG. 2, when the swing frame 230 is coupled to the frame member 12 of the main frame 10 and the main frame 10 is brought to the closed position, the conveyer belt mechanism 264 is located opposed to the transparent plate 8 placed on the upper surface of housing 6 of the electrostatic copying machine 4. The active running portion, i.e., the lower running portion, of the endless belt 272 is pressed onto the transparent plate 8 by the action of the pressing rollers 280. The document is carried along the upper surface of the transparent plate 8 as the endless belt 272 is driven by the rotary drive source 276.

The endless belt 272 in the conveyer belt mechanism 266 directly covers the document placed on the transparent plate 8 and works as a so-called document cover. Therefore, a contaminated endless belt 272 adversely affects the quality of a copy obtained by using the electrostatic copying machine. Therefore, the endless conveyer belt 272 must be replaced as required. To replace the endless conveyer belt, first, the main frame 10 is brought to the open position shown in FIG. 13. Then, the setscrews 246 (FIG. 14) constituting the coupling means are manipulated to separate the swing frame 230 from the frame member 12, and the swing frame 230 is turned from the coupling position indicated by a two-dot chain line in FIG. 13 to the separated position indicated by a solid line in FIG. 13. Thus, the conveyer belt mechanism 266, of which the upper surface had been covered with the frame member 12, is exposed to view. Thereafter, the second support member 238 in the front support means 232 of the swing frame 230 is temporarily anchored at the non-tensioned position indicated by a two-dot chain line in FIG. 15, such that the front portion of the endless belt 272 is relaxed. In consequence, it is possible to very easily remove the used endless belt 272 from the driven belt roller 268 and the follower belt roller 270 and to very easily wrap a new endless belt 272 round the driven belt roller 268 and the follower belt roller 270. Thereafter, the second support member 238 in the front support means 232 is liberated from the non-tensioned position in order to place the endless belt 272 under the tensioned condition. The swing frame 230 is then turned to the coupling position indicated by the two-dot chain line in FIG. 13, and is coupled to the frame member 12 using coupling means (setscrews 246).

With reference to FIG. 2, a document delivery passage 282 is formed in the right end portion of the frame member 12 of the main frame 10. The document delivery passage 282 is defined between a guide plate 284 and a guide plate 286. Driven delivery rollers 288 and 290 are arranged in relation to the document delivery passage 282. There are further arranged a pressing roller 292 that cooperates with the driven delivery roller 288 and a document detector 294 constituted by a microswitch having a detector arm that protrudes into the document delivery passage 282. The constitution related to the document delivery passage 282 in the illustrated automatic document conveying device 2 may be the known one and is not described here in detail.

The operation of the illustrated automatic document conveying device 2 will now be summarily described by reference chiefly to FIG. 2. To convey the document to be copied, the automatic document conveying device 2 is set to be as shown in FIG. 2, i.e., the main frame 10 is brought to the closed position. The documents are stacked one upon another in the order of pages with their surfaces to be copied being faced upwards. The stacked documents are placed on a document placing means 18, and are inserted in the upstream end of the document introduction passage 108 until the leading edges of the stacked documents come in contact with the stopper member 60 that is at the acting position indicated by a solid line in FIGS. 2 and 3. At this time, the document detector 103 detects the documents. A copying start button disposed on the electrostatic copying machine 2 is pushed. The stopper member 60 is then retracted to the non-acting position indicated by the two-dot chain line in FIGS. 2 and 3, and the pressing member 88 is brought from the non-acting position indicated by the solid line in FIGS. 2 and 3 to the acting position indicated by the two-dot chain line in FIGS. 2 and 3. At the same time or immediately thereafter, the introduction roller 54, feed roller 56 and separation roller 128 are rotated (introduction roller 54, feed roller 56 and separation roller 128 are rotated by the common rotary driving source 84 shown in FIGS. 5 and 6). Due to the introduction roller 54 and the pressing member 88 that work in cooperation, one of few pieces of documents are introduced from the lowermost position of a plurality of documents that are stacked. Then, due to the feed roller 56 and the restricting member 156 that work in cooperation, the documents introduced into between the feed roller 56 and the separation roller 128 are limited to be smaller than two pieces from the lowermost position. Due to the feed roller 56 and the separation roller 128 that work in cooperation, only one piece of document at the lowermost position is allowed to be conveyed passing through the upstream portion of the document introduction passage 108. When the document is detected by the document detector 64, the introduction roller 54, feed roller 56 and separation roller 128 stop rotating. At the same time, the pressing member 88 is returned back to the non-acting position indicated by the solid line in FIGS. 2 and 3. At this moment, the leading edge of the document is positioned at the nip portion between the conveyer roller 62 and the pressing roller 66. Then, after the lapse of some period of time, the introduction roller 54, feed roller 56 and separation roller 128 are driven again, and the conveyer roller 62, conveyer belt mechanism 266, and delivery rollers 288 and 290 are rotated (conveyer roller 62, conveyer belt mechanism 266 and delivery rollers 288, 290 are rotated by the common rotary drive source 276 shown in FIG. 13). Thus, the document introduced into the document introduction passage 108 is restarted to be conveyed. When the trailing edge of the document passes over the document detector 70 and no document is detected by the document detector 70, the introduction roller 54, feed roller 56 and separation roller 128 stop rotating. The conveyer roller 62, conveyer belt mechanism 266, and delivery rollers 288, 290 stop rotating after the lapse of a predetermined period of time from a moment when the trailing edge of the document has passed over the document detector 70. At this moment, the document has been introduced onto the transparent plate 8 of the electrostatic copying machine 2. Then, the conveyer belt mechanism 266 (as well as conveyer roller 62 and delivery rollers 288, 290) is rotated in the reverse direction for only a predetermined period of time, whereby the document on the transparent plate 8 is conveyed to some extent leftwardly in FIG. 2 and is placed in a required position on the transparent plate 8. The document is then put to a required copying step in the electrostatic copying machine 2. After the copying step is finished, the conveyer belt mechanism 266 and the discharge rollers 288, 290 (as well as conveyer roller 62) are rotated, and the document is conveyed from the transparent plate 8 passing through the document delivery passage 282. The conveyer belt mechanism 266 and delivery rollers 288, 290 (as well as conveyer roller 62) stop rotating after the lapse of some period of time from a moment when the trailing edge of the document has passed over the document detector 294 which detects no document. At this moment, the document has been discharged onto the document receiving means 30 through the document delivery passage 282. Thereafter, the above-mentioned procedure of conveyance is repeated until the document at the uppermost position on the document placing means 18 is conveyed. As the document at the uppermost position is conveyed through the document introduction passage 108 and the document detector 103 does not detect the document any more, the stopper member 60 is returned back to the non-acting position indicated by the solid line in FIGS. 2 and 3.

In the automatic document conveying device constituted according to the first aspect of the present invention, the documents that happened to be jammed in the document introduction passage can be removed very easily without being damaged and without being hindered by the pressing member by simply turning the opening/closing frame to the open position.

In the automatic document conveying device constituted according to the second aspect of the present invention, it is possible to very easily replace the separation roller that is disposed in the document introduction passage.

In the automatic document conveying device constituted according to the third aspect of the present invention, the restricting member disposed in the document introduction passage functions as required in order to reliably prevent the documents from being damaged by the restricting member.

In the automatic document conveying device constituted according to the fourth aspect of the present invention, the electric wires extending from the opening/closing frame through the opening formed in the side plate of the main frame are reliably prevented from being bit between the opening/closing frame and the side plate of the main frame or from being subjected to an excessive tensile force.

In the automatic document conveying device constituted according to the fifth aspect of the present invention, space having a minimum reduced size in the conveying direction is used for arranging a plurality of document detectors that detect the size of the document, in the direction of width thereof, that is being conveyed through the document introduction passage, enabling the device as a whole to be in a compact size.

In the automatic document conveying device constituted according to the sixth aspect of the present invention, it is possible to very easily replace the endless belt that is used for the conveyer belt mechanism.

In the foregoing was described in detail with reference to the accompanying drawings a preferred embodiment of the automatic document conveying device constituted according to the present invention. It should, however, be noted that the invention is in no way limited to the above embodiment only but can be modified or changed in a variety of other ways without departing from the scope of the present invention.

What we claim is:

1. An automatic document conveying device for an image processor equipped with a housing having a transparent plate on an upper surface thereof, said automatic document conveying device comprising:

a main frame adapted to be swingably mounted on a main frame swing axis extending along one edge of the transparent plate for swinging between a closed position on which said main frame covers the transparent plate and an open position on which said main frame permits the transparent plate to be exposed to view, a swing frame swingably mounted on said main frame to swing on a separation swing axis extending in parallel with and close to said main frame swing axis, coupling means releasably coupling said swing frame to said main frame, and a conveyer belt mechanism mounted on said swing frame, and thus on said main frame, said conveyor belt mechanism including a conveyor belt and positioned so that when said main frame is in said closed position with said swing frame coupled to said main frame by said coupling means, said conveyor belt mechanism is opposed to the transparent plate and when said main frame is in said open position with said swing frame coupled to said main frame by said coupling means, said conveyor belt mechanism is removed from the transparent plate and said coupling means can be released said swing frame from said main frame so that said swing frame and said conveyor belt mechanism swing away from said main frame to a position adjacent the transparent plate, permitting access to said conveyor belt.

2. An automatic document conveying device according to claim 1, wherein:

said main frame has a box-like shape with an open lower surface, said swing frame includes a pair of support means arranged a distance apart in a direction perpendicular to the direction of said main frame swing axis and extending in the direction of said main frame swing axis, said conveyer belt mechanism includes a pair of belt rollers mounted a distance apart in the direction of said main frame axis between said pair of support means, said conveyor belt includes an endless belt wrapped round said pair of belt rollers, said conveyer belt mechanism is covered by said main frame when said swing frame is coupled to said main frame, and at least major portions of said conveyer belt mechanism are exposed to view when said swing frame is swung on said separation swing axis and said swing frame and said conveyor belt mechanism are separated from said main frame.

3. An automatic document conveying device according to claim 2, wherein:

at least one of said pair of support means of said swing frame remote from said separation swing axis includes a first support member, a second support member coupled to said first support member and movable in the direction of said separation swing axis, and resilient urging means for resiliently urging said second support member in a direction away from said first support member, and one of said pair of belt rollers is mounted on said first support member and the other of said pair of belt rollers is mounted on said second support member.

4. An automatic document conveying device according to claim 3, further comprising anchoring means for releasably anchoring said second support member at a position toward said first support member against the resilient urging action of said resilient urging means.

5. An automatic document conveying device according to claim 1, further comprising a rotary driving source mounted on said swing frame and drivably coupled to said conveyer belt mechanism.

6. An automatic document conveying device according to claim 1, wherein:

said main frame swing axis and said separation swing axis extend along the rear edge of the transparent plate in the vicinity thereof, and said coupling means releasably couples the front edge of said swing frame to the front edge of said main frame.

7. An automatic document conveying device according to claim 1, wherein when said main frame is in said open position with said swing frame swung away from said main frame, said conveyor belt mechanism is supported in a substantially horizontal position above the transparent plate.

* * * * *